US010537496B2

(12) United States Patent
Geltser et al.

(10) Patent No.: US 10,537,496 B2
(45) Date of Patent: Jan. 21, 2020

(54) METHOD AND APPARATUS FOR THE COUNTING AND DISPENSING OF TABLETS

(71) Applicant: Capsa Solutions, LLC, Portland, OR (US)

(72) Inventors: Aleksandr R. Geltser, Stamford, CT (US); Samuel Dworkin, Stamford, CT (US)

(73) Assignee: Capsa Solutions, LLC, Portland, OR (US)

( * ) Notice: Subject to any disclaimer, the term of this patent is extended or adjusted under 35 U.S.C. 154(b) by 0 days.

(21) Appl. No.: 15/655,084

(22) Filed: Jul. 20, 2017

(65) Prior Publication Data

US 2019/0021956 A1 Jan. 24, 2019

(51) Int. Cl.

| | |
|---|---|
| ***A61J 7/02*** | (2006.01) |
| ***A61J 7/04*** | (2006.01) |
| ***A61J 7/00*** | (2006.01) |
| ***G07F 17/00*** | (2006.01) |
| ***G07F 11/44*** | (2006.01) |
| *B65B 5/10* | (2006.01) |
| *B65B 57/20* | (2006.01) |
| *B65B 35/14* | (2006.01) |

(52) U.S. Cl.

CPC ..... *A61J 7/02* (2013.01); *A61J 7/0076* (2013.01); *A61J 7/04* (2013.01); *G07F 11/44* (2013.01); *G07F 17/0092* (2013.01); *A61J 2200/70* (2013.01); *A61J 2205/40* (2013.01); *A61J 2205/60* (2013.01); *B65B 5/103* (2013.01); *B65B 35/14* (2013.01); *B65B 57/20* (2013.01)

(58) Field of Classification Search

CPC .... A61J 7/02; A61J 7/0076; A61J 7/04; G07F 11/44; G07F 17/0092

USPC ..... 221/10, 7, 200, 277, 2, 127, 160, 12; 198/33, 398, 380

See application file for complete search history.

(56) References Cited

U.S. PATENT DOCUMENTS 2,904,162 A * 9/1959 Simer ..... H01J 9/46 198/380
3,012,651 A * 12/1961 Hawkes ..... B65G 47/1421 198/380
3,265,273 A * 8/1966 Janus ..... B31B 50/00 227/2
3,746,211 A * 7/1973 Burgess, Jr. ..... G06M 3/02 221/7
3,747,738 A * 7/1973 Greck ..... B65G 51/02 406/31
4,825,995 A * 5/1989 Nalbach ..... B65G 47/1457 198/380

(Continued)

*Primary Examiner* — Rakesh Kumar

(74) *Attorney, Agent, or Firm* — Gordon & Jacobson, P.C.

(57) ABSTRACT

An apparatus for counting and dispensing tablets includes a vibratory tablet feeder for feeding tablets to be counted to an output opening, at least one electrically-controlled vibrator coupled to the tablet feeder for vibrating the tablet feeder such that a singulated flow of tablets exits the output opening, and an optical system including at least one light source and at least one detector array located about a channel disposed downstream from the output opening of the tablet feeder. The optical system is configured to count tablets that pass through the channel as well as determine a tablet size class for the tablets that pass through the channel. Operation of the at least one electrically-controlled vibrator is controlled based on the tablet size class determined by the optical system.

12 Claims, 18 Drawing Sheets

(56) References Cited

U.S. PATENT DOCUMENTS 5,065,852 A * 11/1991 Marti ..... B65B 35/56 198/392
5,317,645 A * 5/1994 Perozek ..... G06M 11/00 209/522
5,419,442 A * 5/1995 Wright, Jr. ..... B07C 5/36 198/391
5,473,703 A 12/1995 Smith
5,507,086 A * 4/1996 Marshall ..... B65C 7/00 29/453
5,553,737 A * 9/1996 Kelly ..... B65G 47/1421 221/167
5,638,417 A * 6/1997 Boyer ..... A61J 7/02 377/6
5,671,262 A * 9/1997 Boyer ..... G06M 1/101 377/11
5,804,772 A * 9/1998 Wooldridge ..... G01G 19/42 177/105
6,435,333 B1 * 8/2002 Sala ..... B65G 47/1457 198/384
6,578,733 B2 6/2003 Geltser et al.
6,659,304 B2 * 12/2003 Geltser ..... A61J 7/0076 221/277
7,128,203 B2 * 10/2006 Baranowski ..... G01G 13/24 198/752.1
7,139,639 B2 * 11/2006 Broussard ..... A61J 7/02 700/225
7,258,222 B2 * 8/2007 Marti Sala ..... B65G 47/1464 198/393
8,393,495 B2 * 3/2013 Kim ..... B65B 5/103 221/10
8,417,375 B2 * 4/2013 Horev ..... G06M 7/00 700/230
8,700,208 B2 * 4/2014 Kim ..... B65B 35/14 198/757
9,180,992 B2 * 11/2015 Kim ..... B65B 37/04
2009/0114665 A1 * 5/2009 Ogawa ..... B65G 47/1421 221/2
2010/0108404 A1 * 5/2010 Kieselhorst ..... G01G 19/393 177/25.18
2013/0054017 A1 * 2/2013 Horev ..... G06M 7/00 700/240
2013/0144431 A1 * 6/2013 Tidhar ..... B65B 5/103 700/231
2015/0175287 A1 * 6/2015 Tidhar ..... B65B 5/103 700/240

* cited by examiner

Look-up Table 400

| Tablet Size Class Index (pixel size range) | Setpoint Vibration Amplitude for Initial Counting Phase | Setpoint Vibration Amplitude for Counting Phase | Setpoint Vibration Amplitude for Slow-Down Counting Phase | Setpoint Vibration Amplitude for Last 2-Count Counting Phase | Setpoint Vibration Amplitude for Last 1-Count Counting Phase | Count_value for transistion to Slow-Down Counting Phase |
|---|---|---|---|---|---|---|
| Default | $SP\text{-}VA_{D\text{-}ICP}$ | | | | | |
| pixel size range 1 | $SP\text{-}VA_{1\text{-}ICP}$ | $SP\text{-}VA_{1\text{-}CP}$ | $SP\text{-}VA_{1\text{-}SDCP}$ | $SP\text{-}VA_{1\text{-}2CCP}$ | $SP\text{-}VA_{1\text{-}1CCP}$ | $CV\text{-}SDCP_1$ |
| pixel size range 2 | $SP\text{-}VA_{2\text{-}ICP}$ | $SP\text{-}VA_{2\text{-}CP}$ | $SP\text{-}VA_{2\text{-}SDCP}$ | $SP\text{-}VA_{2\text{-}2CCP}$ | $SP\text{-}VA_{2\text{-}1CCP}$ | $CV\text{-}SDCP_2$ |
| pixel size range 3 | $SP\text{-}VA_{3\text{-}ICP}$ | $SP\text{-}VA_{3\text{-}CP}$ | $SP\text{-}VA_{3\text{-}SDCP}$ | $SP\text{-}VA_{3\text{-}2CCP}$ | $SP\text{-}VA_{3\text{-}1CCP}$ | $CV\text{-}SDCP_3$ |
| pixel size range 4 | $SP\text{-}VA_{4\text{-}ICP}$ | $SP\text{-}VA_{4\text{-}CP}$ | $SP\text{-}VA_{4\text{-}SDCP}$ | $SP\text{-}VA_{4\text{-}2CCP}$ | $SP\text{-}VA_{4\text{-}1CCP}$ | $CV\text{-}SDCP_4$ |
| pixel size range 5 | $SP\text{-}VA_{5\text{-}ICP}$ | $SP\text{-}VA_{5\text{-}CP}$ | $SP\text{-}VA_{5\text{-}SDCP}$ | $SP\text{-}VA_{5\text{-}2CCP}$ | $SP\text{-}VA_{5\text{-}1CCP}$ | $CV\text{-}SDCP_5$ |
| ⋮ | ⋮ | ⋮ | ⋮ | ⋮ | ⋮ | ⋮ |

FIG. 4

METHOD AND APPARATUS FOR THE COUNTING AND DISPENSING OF TABLETS

BACKGROUND

1. Field

The present application relates to a method and apparatus for counting and dispensing discrete objects, and, more particularly, to a computerized method and apparatus for counting and dispensing pharmaceutical tablets, capsules, caplets and the like ("tablets").

2. State of the Art

Optical counters have been utilized in various applications to count objects. Typically, these counters include a feed system to reduce the collection of objects to a single-file orderly line, an optical sensor apparatus and a counting system. Various mechanical systems for producing a single-file flow include rotational and linear vibrators, rotating discs, air jets, gravity feeds, moving belts, etc. In such optical counters, the counting apparatus that performs the actual count of a single-file flow is simple in concept. A light source is placed opposite a single optical sensor and the object stream is directed between the sensor and the light source. The shadows created by the objects yield alternating light and dark patterns on the sensor. The sensor produces an electrical signal representative of these patterns and transmits the electrical signal to an electrical counting apparatus.

Accurate counts may be possible if the flow of objects is in a discrete series of single objects. Any failure of the mechanical feed system that results in flow that is not discrete can cause an inaccurate count. Inaccurate counts are due to the operation of the sensor which changes state in response to the presence or absence of light without respect to whether a light blockage is caused by one or more objects. Thus, if two or more objects cross the sensor simultaneously or if two or more objects are in physical contact, the count can be erroneous because a one-to-one correspondence between discrete objects and sensor state changes does not exist. This condition in the object flow stream is referred to as "bunching".

In this type of counter, stringent demands are placed on the feed system because of the unforgiving nature of the sensors. These systems are typically complex and require parts changes and adjustments for each different size and shape object being counted. Thus, the set up requires a skilled operator. An object counter of this kind may achieve accurate count by sacrificing on size, complexity, and cost.

Heretofore known electronic systems are not highly accurate, particularly when small objects such as pharmaceutical capsules, tablets, etc. are to be counted. Such systems have lacked the sophisticated sensing and counting electronics and "intelligent" controls.

SUMMARY

In accordance with an aspect, which will be discussed in detail below, a vibratory counting and dispensing apparatus is provided for counting and dispensing pharmaceutical tablets, capsules, caplets and the like ("tablets"). The vibratory counting and dispensing apparatus includes a feed hopper that stores a supply of tablets. A feeder vibrator is configured to vibrate a linear feeder such that tablets stored in the feed hopper are conveyed via the linear feeder to a feed bowl such that the feed bowl that stores a supply of tablets. The peripheral region of the interior of the feed bowl has a spiral ramp that leads to an exit opening. The feed bowl is vibrated by one or more electrically-controlled feed bowl vibrators in a manner that causes a plurality of tablets stored in the feed bowl to move as a singulated flow of tablets to the exit opening. The singulated flow is a conveying process where the tablets are separated for counting. Typically, the tablets move in single file one after the other in the singulated flow. The singulated flow of tablets pass through the exit opening of the feed bowl for supply to an optical system. The singulated flow of tablets is counted by the optical system and output or dispensed from a discharge chute.

In one embodiment, the optical system includes at least one light source and at least one detector array located about a channel disposed downstream from the exit opening of the bowl. The optical system is configured to count the singulated flow of tablets supplied to the optical system as well as determine a tablet size class for the tablets of the singulated flow. Furthermore, the operation of the at least one feed bowl vibrator is controlled based on the tablet size class determined by the optical system.

For example, the vibration amplitude of the at least one feed bowl vibrator can be controlled based on the tablet size class determined by the optical system. In another example, the vibration amplitude of the at least one feed bowl vibrator can be controlled based on the tablet size class determined by the optical system and number of objects counted by the optical system.

In embodiment(s), the vibratory counting and dispensing apparatus can include an electronic controller configured to control vibration amplitude of the at least one feed bowl vibrator based on the tablet size class and the number of tablets counted. The controller can employ a look-up table implemented in computer memory which electronically stores one or more setpoint vibration amplitude values for a number of tablet size classes. The optical system can be used to determine or update the tablet size class during a counting and dispensing operation that counts and dispenses a desired number of tablets. The setpoint vibration amplitude value corresponding to such table size class as stored in the look-up table can be used to update or change the target vibration amplitude value for control of the vibration amplitude of the at least one feed bowl vibrator during the counting and dispensing operation.

In one embodiment, the counting and dispensing operation of the vibratory counting apparatus can be logically partitioned into a predefined set of counting phases. In this case, the look-up table can store a number of setpoint vibration amplitude values associated with the predefined set of counting phases for each respective tablet size class.

In one embodiment, the predefined set of counting phases can include an initial counting phase carried out by the vibratory counting apparatus after an initial power-up sequence. In this case, the look-up table stores a default setpoint vibration amplitude that can be used as a target vibration amplitude value for control of the vibration amplitude of the at least one feed bowl vibrator during the initial counting phase. The optical system can be used to determine or update the tablet size class during the initial counting phase, and the setpoint vibration amplitude value corresponding to such table size class as stored in the look-up table can be used to update or change the target vibration amplitude value for control of the vibration amplitude of the at least one feed bowl vibrator during the initial counting phase. The controller may be configured to transition out of the initial counting phase when the vibration amplitude of the at least one feed bowl vibrator exceeds the target vibration amplitude value for the initial counting phase.

In other embodiments, the predefined set of counting phases can include a first sequence of counting phases carried out by the vibratory counting apparatus after the initial counting phase. In this case, the look-up table stores setpoint vibration amplitude values that can be used as a target vibration amplitude value for control of the vibration amplitude of the at least one feed bowl vibrator during the first sequence of counting phases. The optical system can be used to determine or update the tablet size classification during the first sequence of counting phases, and the setpoint vibration amplitude value corresponding to such table size classification as stored in the look-up table can be used to update or change the target vibration amplitude value for control of the vibration amplitude of the at least one feed bowl vibrator during the first sequence of counting phases.

In embodiment(s), the controller may be configured to perform closed loop control of a vibrator voltage level based on difference between a measured amplitude of vibration of the least one feed bowl vibrator and a current target vibration amplitude value. The controller may increase the vibrator voltage level if the measured amplitude of vibration is less than the current target vibration amplitude value, and the controller may decrease the vibrator voltage level if the measured amplitude of vibration is greater than the current target vibration amplitude value.

In still other embodiments, the controller can be configured to electronically store in computer memory data representing most-recent voltage levels at the setpoint vibration amplitude values for the first sequence of counting phases. Such data can be used in follow-on counting and dispensing operations to control the vibration amplitude of the at least one feed bowl vibrator during such follow-on counting and dispensing operations. For example, the follow-on counting and dispensing operations can be logically partitioned into a second sequence of counting phases each corresponding to different counting phases of the first sequence. In this case, during a respective counting phase of the second sequence, the data representing the most-recent voltage level at the setpoint vibration amplitude value for the corresponding counting phase of the first sequence can be used to initially control the at least one feed bowl vibrator.

In one embodiment, the first sequence of counting phases includes a counting phase, a slow-down counting phase, a last 2-count counting phase, and a last 1-count counting phase. The controller may be configured to transition from the counting phase to a slow-down counting phase when the cumulative number of counted and dispensed tablets is greater than or equal to a threshold value. The threshold value can be determined from one or more parameters stored in the look-up table for the respective table size class. The controller may be configured to transition from the slow-down counting phase to the last 2-count counting phase when a difference between the target number of tablets to be counted and dispensed and the cumulative number of counted and dispensed tablets is 2. The controller may be configured to transition from the last 2-counting phase to a last 1-count counting phase when the difference between the target number of tablets to be counted and dispensed and the cumulative number of counted and dispensed tablets is 1. In the last 1-count counting phase, the controller may be configured to perform an overcount condition processing when the cumulative number of counted and dispensed tablets is greater than the target number of tablets to be counted and dispensed, and the controller may be configured to perform a correctcount condition processing when the cumulative number of counted and dispensed tablets is equal to the target number of tablets to be counted and dispensed.

BRIEF DESCRIPTION OF THE DRAWINGS

FIG. 4 is an exemplary look-up table that can be used in the workflow of FIGS. 2A and 2B.

DETAILED DESCRIPTION

As used herein the term "singulated flow" means a conveying process where tablets are separated for counting. Typically, the tablets move in single file, one after the other, in the singulated flow, although instances can occur where multiple tablets are stacked on top of one another or exist side-by-side one another in the singulated flow.

Figure 1A:
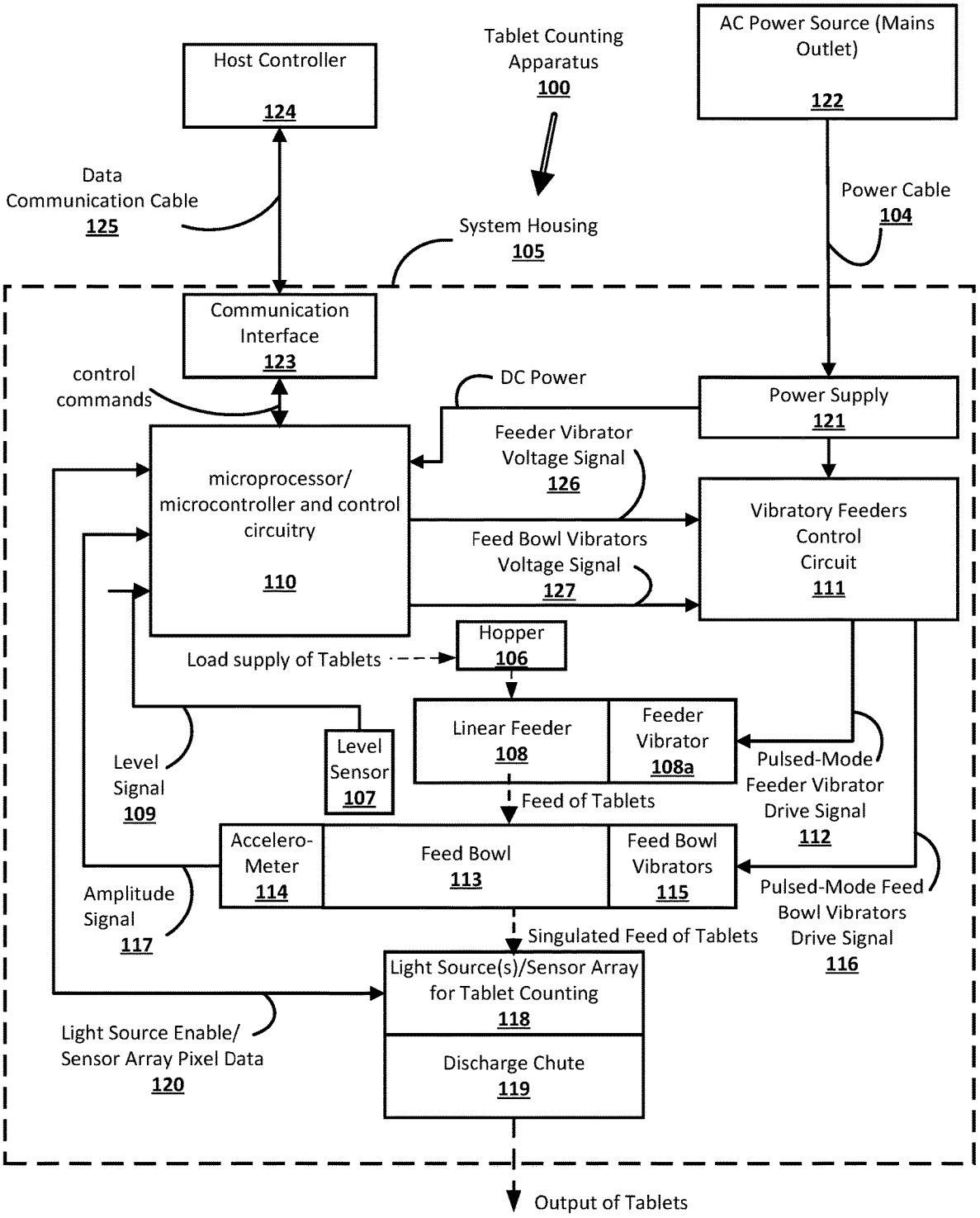
FIG. 1A is a schematic diagram of an embodiment of a tablet counting system.
Figure 1B:
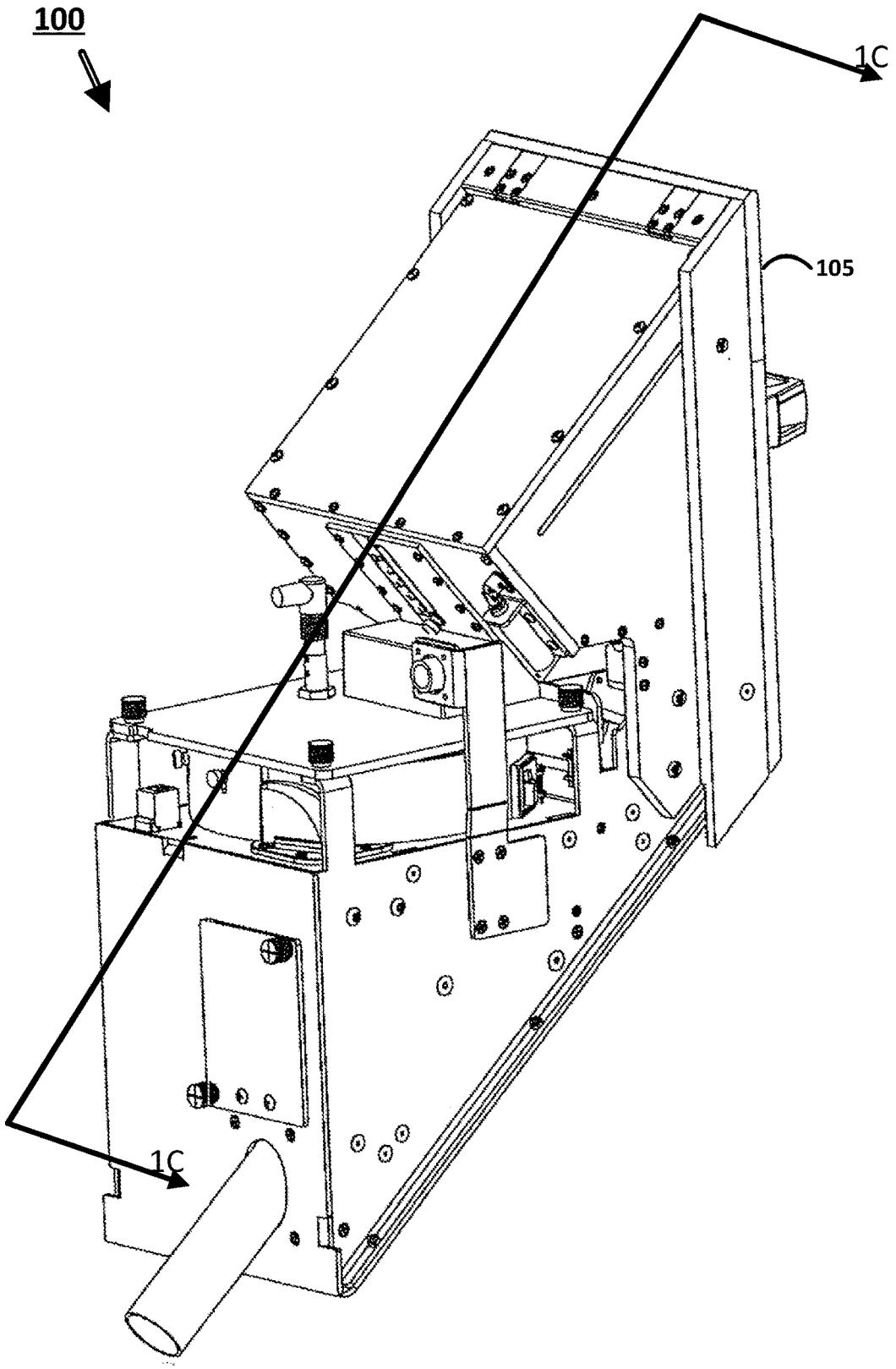
FIG. 1B is an isometric view of an embodiment of a tablet counting system.
Figure 1C:
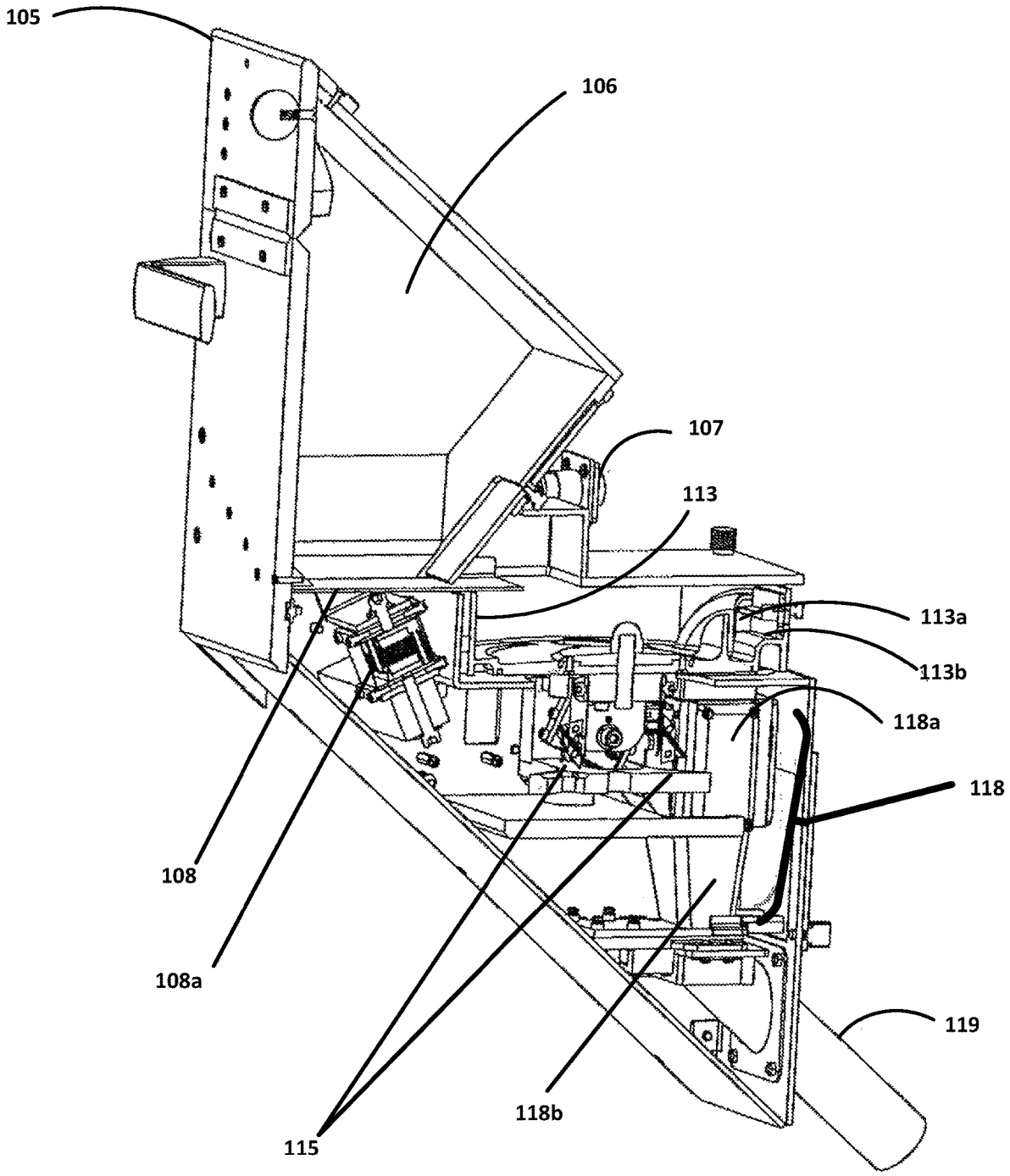
FIG. 1C is a view of the tablet counting system of FIG. 1B viewed along section 1C-1C in FIG. 1B.

Referring to FIGS. 1A to 1C, a vibratory tablet counting apparatus 100 is configured to count tablets (not shown) that are loaded from a feed hopper 106 to a feed bowl 113 of the system 100 as the tablets are being dispensed, i.e., into a container (not shown). Further details of the operation of the vibratory tablet counting apparatus 100 are described below.

As shown in further detail in the section view of FIG. 1C, the feed hopper 106 is supported within a housing 105. The feed hopper 106 is configured to store a supply of tablets. A linear feeder 108 and an electrically-controlled feeder vibrator 108*a* are mounted within the housing 105 such that the linear feeder 108 is coupled to the feed hopper 106. The feeder vibrator 108*a* operates to vibrate the linear feeder 108 such that tablets stored in the feed hopper 106 are conveyed via the linear feeder 108 to a feed bowl 113 mounted within the housing 105. A level sensor 107 can be mounted within the housing 105 and configured to sense the level of the tablets contained in the feed bowl 113. The level sensor 107 can transmit a level signal 109 to processor/control circuitry 110 for control of the feeder vibrator 108*a*, which will be described in greater detail below.

The feed bowl 113 is mounted within the housing 105 on a frame including one or more electronically-controlled feed bowl vibrators 115. The feed bowl 113 stores tablets conveyed from the feed hopper 106. The peripheral region of the interior of the feed bowl 113 has a spiral guide path or ramp 113*b* that leads to an exit opening 113*a*. The feed bowl vibrator(s) 115 operate to vibrate the feed bowl 113 in a manner that causes a plurality of tablets stored in the feed bowl 113 to move by gravity and friction and centripetal force as a singulated flow of tablets along the spiral guide path 113*b* to the exit opening 113*a*. An accelerometer 114 can be mounted within the housing 105 and configured to measure acceleration of the feed bowl 113. The accelerometer 114 can transmit a signal 117 to the processor/control circuitry 110, which can process the signal 117 to measure vibration amplitude of the feed bowl 113 for control of the feed bowl vibrator(s) 115, as will be described in greater detail below.

The singulated flow of tablets that pass through the exiting opening 113*a* is supplied to an optical system 118 supported within the housing 105. The optical system 118 includes at least one light source and at least one sensor array located about a channel 118*a* disposed downstream from the exit opening 113*a* of the feed bowl 113. The optical system 118 is configured to count the singulated flow of tablets that pass through the channel 118*a* as well as determine a size classification for the singulated flow of tablets that pass through the channel 118*a*. The singulated flow of tablets exits from the channel 118*a* for output to a discharge chute 199 supported by the housing 105. The discharge chute 119 is configured to guide the counted tablets from the apparatus 100 to a container (not shown), such as a tablet bottle. Therefore, the flow of tablets is from the hopper 106, to the feed bowl 113, through the channel 118*a* of the optical system 118, and to the discharge chute 119 for dispensing to a container.

In embodiments, the light source of the optical system 118 can include one or more illumination sources that emit electromagnetic radiation (such as infrared light) such that it passes through the channel 118*a* and is blocked in part by subject tablets as they pass through the channel 118*a*. A portion of the unblocked radiation is directed by a focusing mechanism (such as lens) for reception by a corresponding sensor array (such as a linear or area CCD or CMOS image sensor(s)), which function as an image acquisition component. The sensor array(s) repetitively detects (scans) the received radiation at a predetermined, substantially constant rate and generates image pixel data that is converted into the digital domain and processed by the processor/control circuitry 110 to generate a count of the singulated flow of tablets that pass through the channel 118*a* as well as determine a size classification for the singulated flow of tablets that pass through the channel 118*a*. The processor/control circuitry 110 can transmit an enable/disable signal to activate/deactivate certain components of the optical system 118 (such the light source and/or sensor array) as needed.

In embodiments, the image pixel data can be processed by the processor/control circuitry 110 to provide a count of discretely identifiable tablets in several consecutive scan lines or in one or more image frames. Furthermore, the image pixel data can be processed by the processor/control circuitry 110 to approximate the areal coverage or "blob size" of the tablets being counted in several consecutive scan lines or one or more image frames, and determine a size classification that matches such areal coverage. Furthermore, where the approximated areal coverage is too small to be consistent with any anticipated tablet, the tablet may be tagged as possibly chipped or a fragment. Similarly, where the approximated areal coverage shows a shape that is non-uniform, exceeds a stipulated range of curvature, or otherwise exceeds predefined geometric limits, the tablet may be tagged as possibly defective.

As shown in FIG. 1A, the apparatus 100 can also include a power supply 121 that is electrically connected to and is powered by an external power source 122, which may be an alternating current (AC) power source (mains outlet). The power supply 121 is electrically connected to and powers the processor/control circuitry 110 and the vibratory feeders control circuit 111, which powers the feeder vibrator 108*a* and the feed bowl vibrators 115. The power supply 121 may be an AC to DC current switching power supply to supply DC power to the processor/control circuitry 110 and/or the vibratory feeders control circuit 111.

As noted above, the processor/control circuitry 110 can be configured to receive a level signal 109 from the level sensor 107 for control of the feeder vibrator 108*a*. Specifically, the processor/control circuitry 110 outputs a feeder vibrator voltage signal 126 for supply to the vibratory feeder control circuit 111, which is configured to transmit a pulsed-mode feeder vibrator drive signal 112 to the feeder vibrator 108*a* based upon a feeder vibrator voltage signal 126. When the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*. This aforementioned feedback arrangement can be performed repetitively during operation of the apparatus 100 so that an adequate supply of tablets is present in the feed bowl 113 to be counted.

Furthermore, as noted above, the processor/control circuitry 110 can be configured to receive a signal 117 from the accelerometer 114 for control of the feed bowl vibrator(s) 115. Specifically, the processor/control circuitry 110 outputs a feed bowl vibrators voltage signal 127 for supply to the vibratory feeder control circuitry 111, which is configured to transmit a pulsed-mode feed bowl vibrators drive signal 116 to the feed bowl vibrators 115 based upon a feed bowl vibrators voltage signal 127. During operation of the device, the signal 117 from the accelerometer 114 can be used measure vibration amplitude of the feed bowl 113, which is used to provide feedback for automatic control of the vibration amplitude of the feed bowl 113 by the processor/ control circuitry 110 via the feed bowl vibrators voltage signal 127 supplied to the vibratory feeder control circuitry 111.

Also, as shown in FIG. 1A, the apparatus 100 can also include a communication interface 123 that is communicatively coupled between the processor/control circuitry 110 and an external host controller 124 (which is external to the apparatus 100). The external host controller 124 may be coupled to the communication interface 123 via a communication link 125, which may be a wired (e.g., data communication cable shown in FIG. 1A) or a wireless communication link. The host controller 124 can be configured to communicate instructions and/or data to/from the apparatus 100 via the communication interface 123. The instructions and/or data can control the automatic operation of the apparatus 100, including setting operating parameters (such as the target count) of the apparatus 100 and providing status information to enable troubleshooting and testing of the apparatus 100.

The processor/control circuitry 110 also functions as a task manager for organizing and controlling the operating sequence of one or more software code modules resident in the processor/control circuitry 110, and thus for controlling the automated operation of the apparatus.

While the processor/control circuitry 110 shown in the embodiment of FIG. 1A is described above as controlling the automated operation of the apparatus 100 as well as processing the image pixel data for tablet counting and tablet size classification, it will be appreciated that multiple processors and/or controllers may be used to separately perform those functions or those functions may be performed together on multiple processors and/or controller not shown in FIG. 1A.

Furthermore, the processor/control circuitry 110 shown in the embodiment of FIG. 1A can include at least a microprocessor, microcontroller, processor module or subsystem, programmable integrated circuit, programmable gate array, digital signal processor (DSP), or another control or computing device. The processing operations of the processor/control circuitry 110 can be dictated by a sequence of computer-executable instructions and associated data stored in one or more non-transitory computer-readable or machine-readable storage media. The storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the operations of the processor/control circuitry 110 as described herein may be implemented by running one or more functional modules in an information processing apparatus such as general purpose processors or controllers or application specific chips, such as ASICs, FPGAs, PLDs, SOCs, or other appropriate devices. These modules, combinations of these modules, and/or their combination with general hardware are all included within the scope of the disclosure.

In one embodiment, the operating sequence of the apparatus 100 embodies the following. It is assumed that the hopper 106 is adequately filled with a desired tablet type. The external host controller 124 sends an instruction to the communication interface 123 of the apparatus 100, where such instruction include a count command that specifies a certain number of tablets to be counted and dispensed by the apparatus 100. The instruction is received and processed by the processor/control circuitry 110, which controls the operation of the apparatus 100 to count and dispense the specified number of tablets. Since it is possible that the apparatus 100 may dispense too many or too few tablets, the specified amount of tablets will be referred to as a target quantity.

The processor/control circuitry 110 controls the feeder vibrator 108*a*, which can vibrate the linear feeder 108 to cause tablets in the hopper 106 to flow into the feed bowl 113. The rate of flow of tablets from the hopper 106 to the feed bowl 113 via the linear feeder 108 may be based at least in part on the amplitude of vibration imparted to the linear feeder 108 by the feeder vibrator 108*a*. The feed bowl 113 is vibrated by the feed bowl vibrators 115 under control of the processor/control circuitry 110 such that the tablets stored in the feed bowl 113 move by gravity, friction and centripetal force as a singulated flow of tablets along the spiral guide path 113*b* of the feed bowl 113 to the exit opening 113*a*, which leads to the optical system (source/sensor array) 118. Note that the rate of tablets in the singulated flow of tablets that pass through the exit opening 113*a* of the feed bowl 113 is based at least in part on the amplitude of vibration imparted to the feed bowl 113 by the feed bowl vibrators 115. The singulated flow of tablets that move through the exit opening 113*a* pass through the channel 118*a* of the optical system (light source/sensor array) 118, which generates image pixel data that is converted into the digital domain and processed by the processor/control circuitry 110 to generate a count of the singulated flow of tablets that pass through the channel 118*a* as well as determine a size classification for the singulated flow of tablets that pass through the channel 118*a*. Both the tablet count and size classification can be used by the processor/control circuitry 110 to automatically control the amplitude of vibration imparted to the feed bowl 113 by the feed bowl vibrators 115 in order to automatically increase or decrease the rate of tablets in the singulated flow of tablets conveyed from the feed bowl to the optical system for counting and dispensing, and thereby control the accuracy of the tablet counting and dispensing to minimize overcounts in the dispensing operation.

Figure 2A:
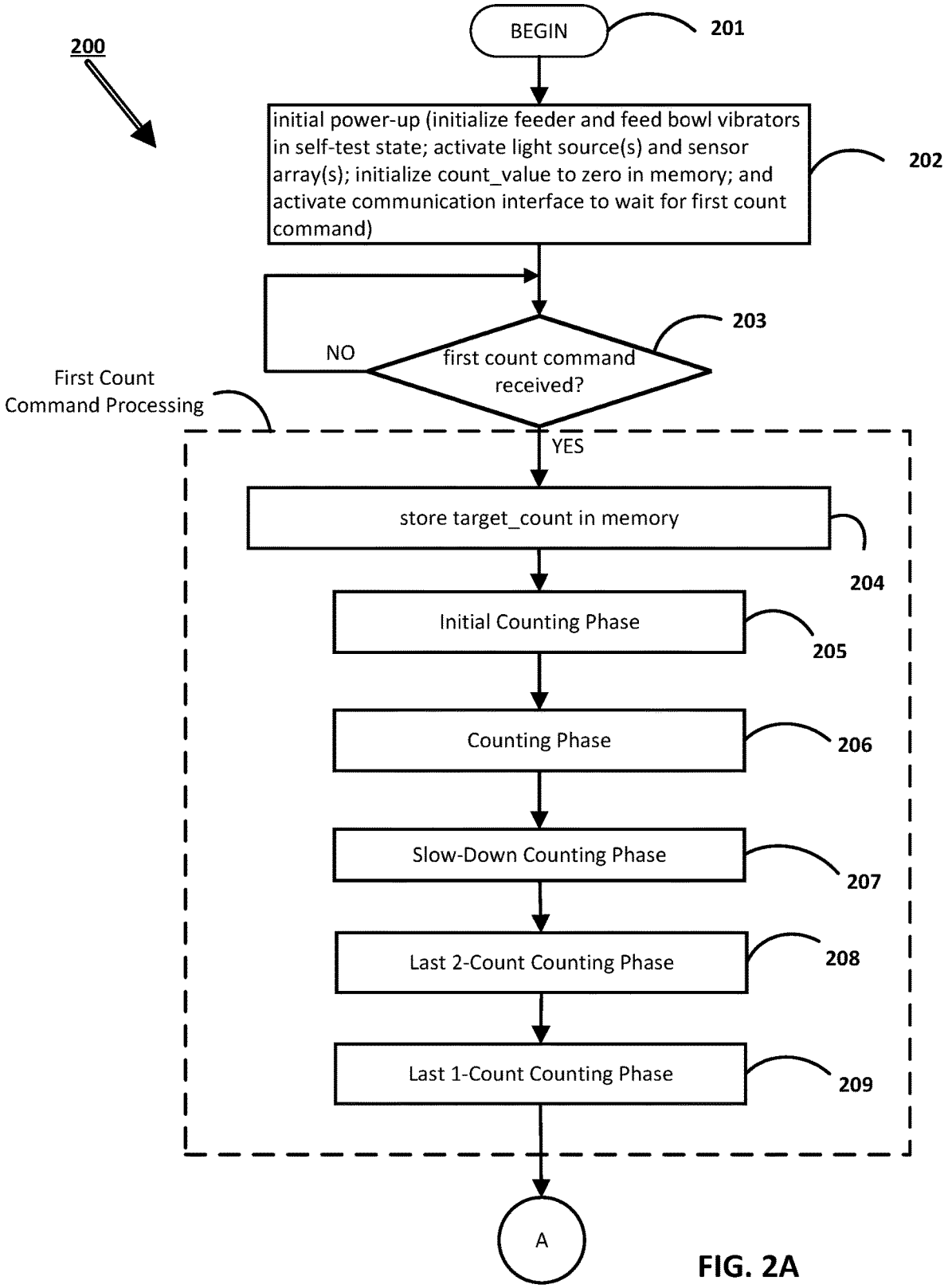
FIGS. 2A and 2B, collectively, is a flowchart illustrating an embodiment of a tablet counting workflow.
Figure 2B:
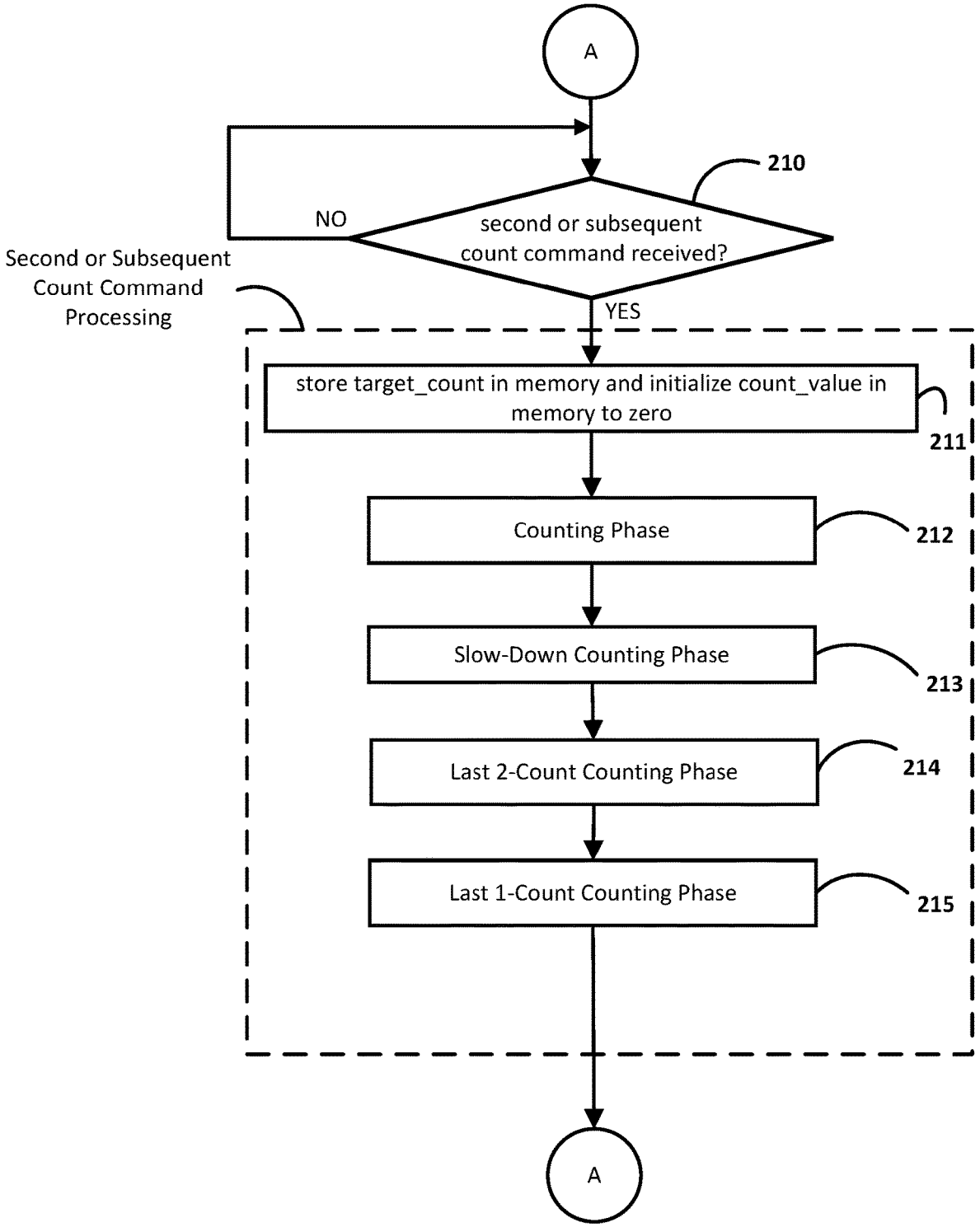

FIGS. 2A and 2B, collectively is a flow chart of automated operations 200 carried out by the processor/control circuitry 110 for dispensing tablets. The operations begin at block 201 at which time the hopper 106 of the apparatus 100 is loaded with tablets, if need be. At block 202 the feeder vibrator 108*a* and the feed bowl vibrators 115 can be initialized in a self-test state with initial parameters. The light source and sensor array(s) of the optical system 118 can be activated and a power-on self-test can be performed, if desired. A count_value variable, which is stored in memory and represent a cumulative number of counted tablets, is initialized to zero. Also, at block 202, the communication interface 123 is activated and placed in a state to wait to receive a count command from the host controller 124. The count command includes a command to the apparatus 100 to dispense a target number of tablets. If a count command is not received ("NO" at block 203), then the apparatus 100 continues to wait and check to determine if a count command is received. However, if a count command is received ("YES" at block 203), then the first count command processing operations of blocks 204 to 209 are performed.

In block 204, a "target count" variable stored in memory is initialized to the target number of tablets as specified by the count command.

Figure 3:
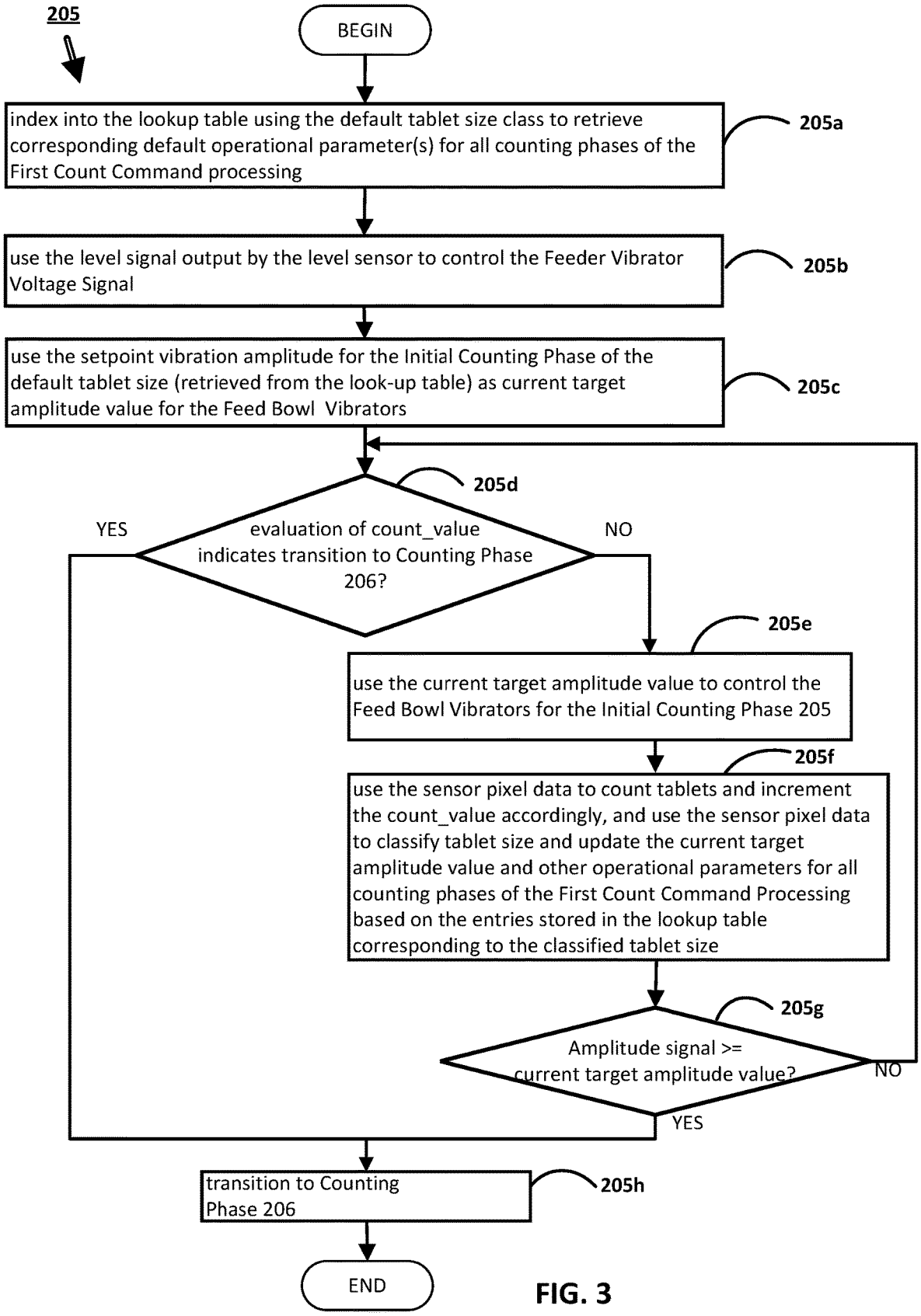
FIG. 3 is a flowchart illustrating exemplary operations can be part of the initial counting phase 212 of the workflow of FIGS. 2A and 2B.

In block 205, an initial counting phase is performed, further details of which are shown with reference to the workflow shown in FIG. 3.

Figure 5:
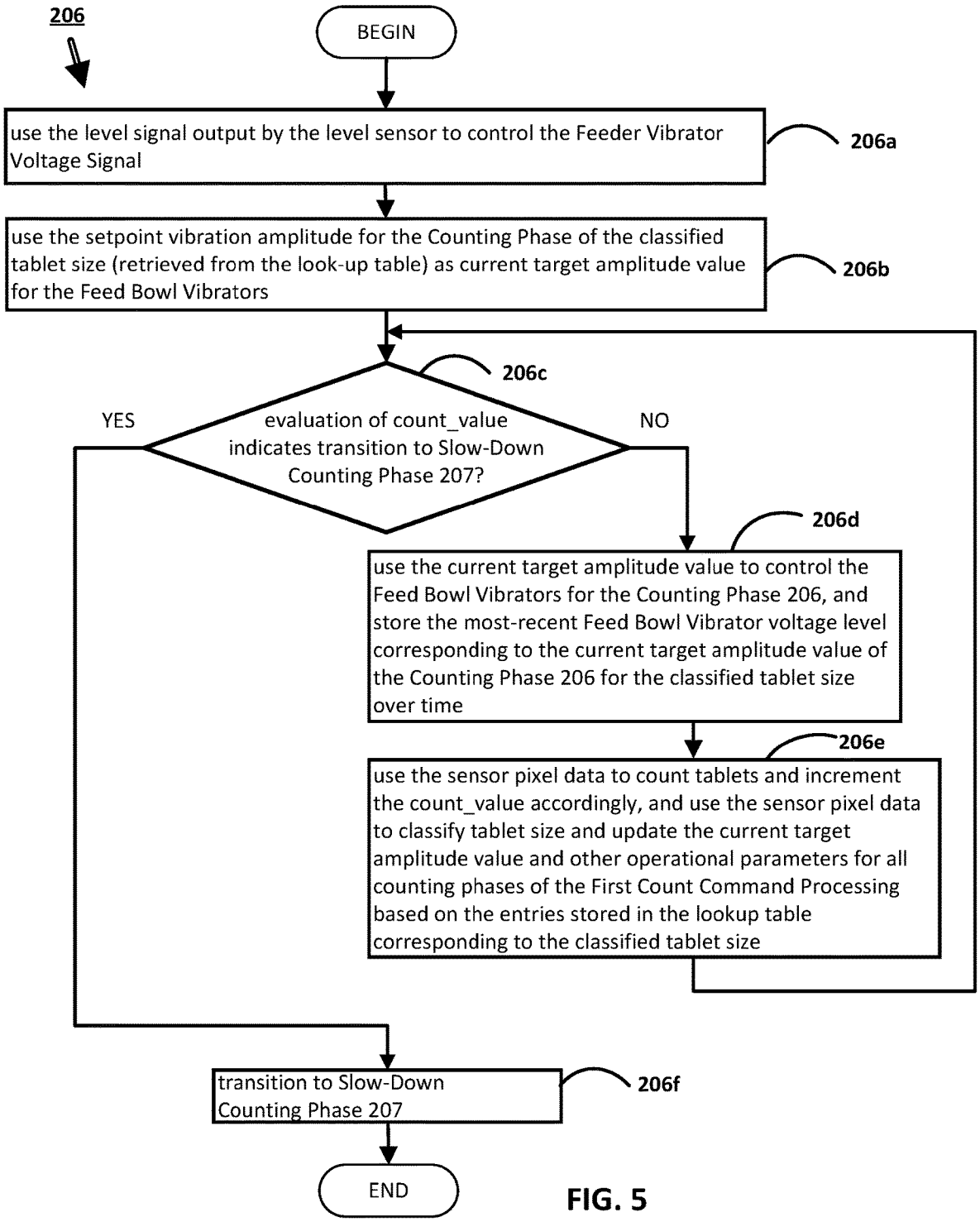
FIG. 5 is a flowchart illustrating exemplary operations that can be part of the counting phase 206 of the workflow of FIGS. 2A and 2B.

Following the initial counting phase, a counting phase 206 may be performed at block 206, further details of which are shown with reference to the workflow shown in FIG. 5.

Figure 6:
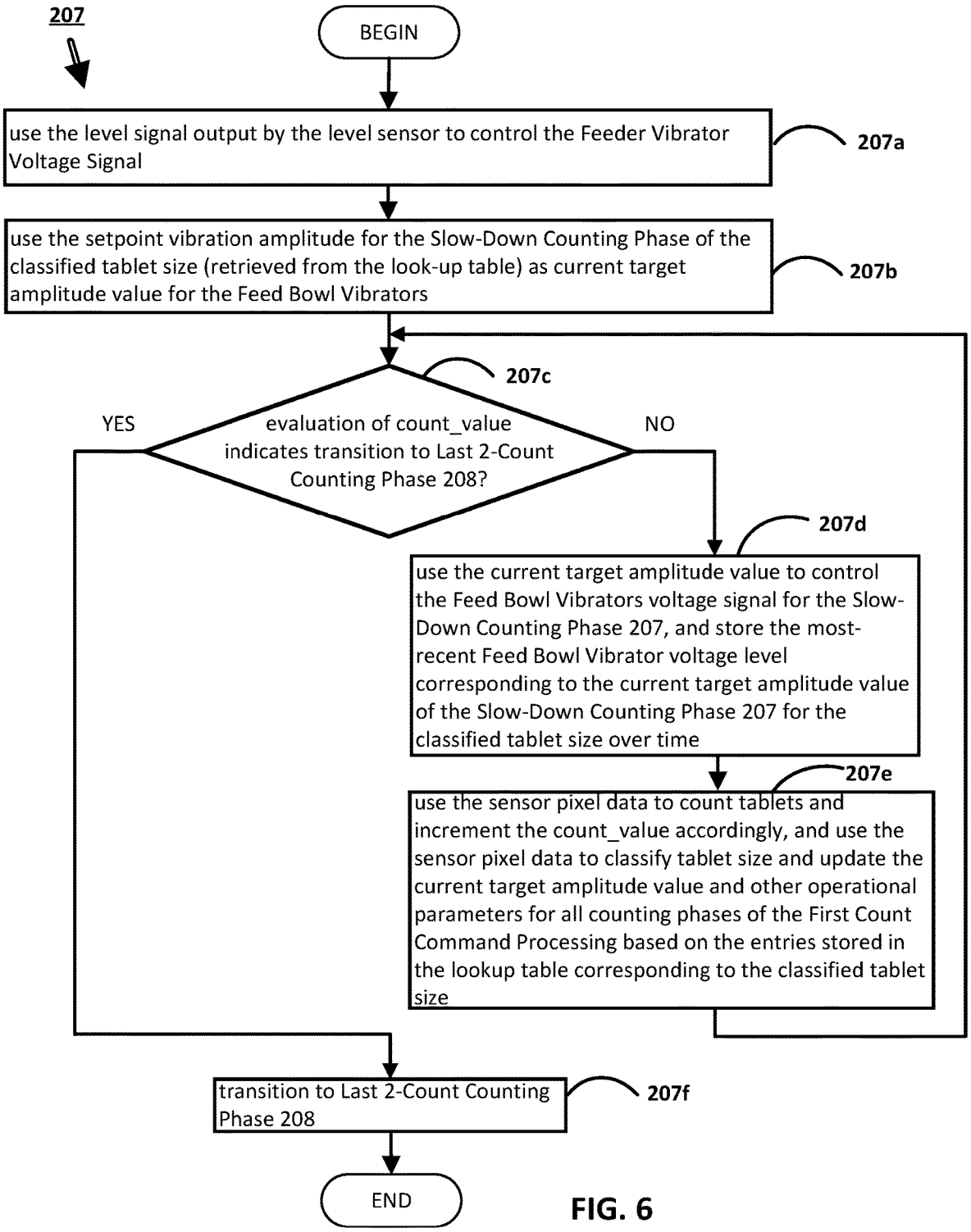
FIG. 6 is a flowchart illustrating exemplary operations that can be part of the slow-down counting phase 207 of the workflow of FIGS. 2A and 2B.

Following the counting phase 206, a slow-down counting phase is performed at block 207, further details of which are shown with reference to the workflow shown in FIG. 6.

Figure 7:
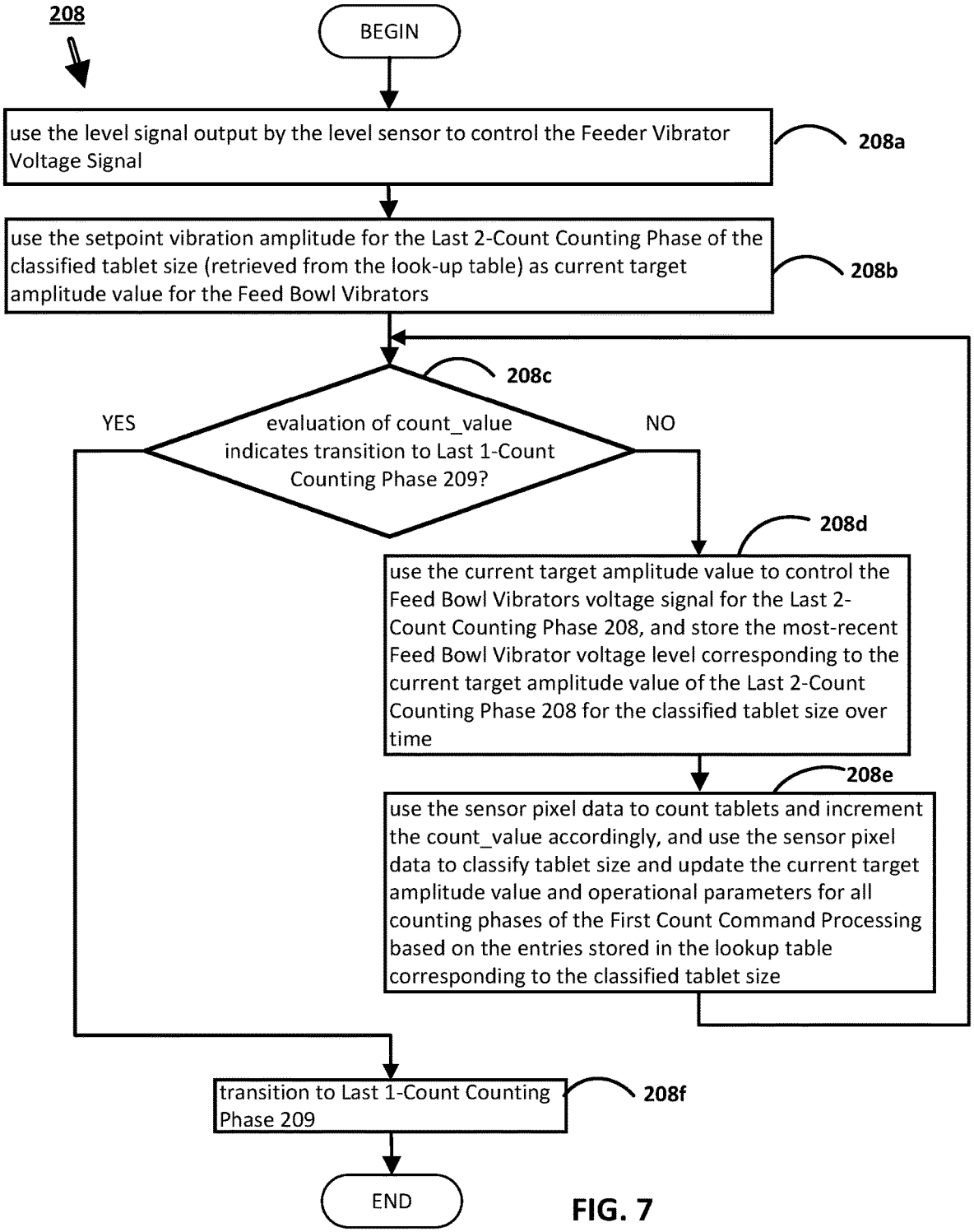
FIG. 7 is a flowchart illustrating exemplary operations that can be part of the last 2-count counting phase 208 of the workflow of FIGS. 2A and 2B.

Following the slow-down counting phase 207, a last 2-count counting phase is performed at block 208, further details of which are shown with reference to the workflow shown in FIG. 7.

Figure 8:
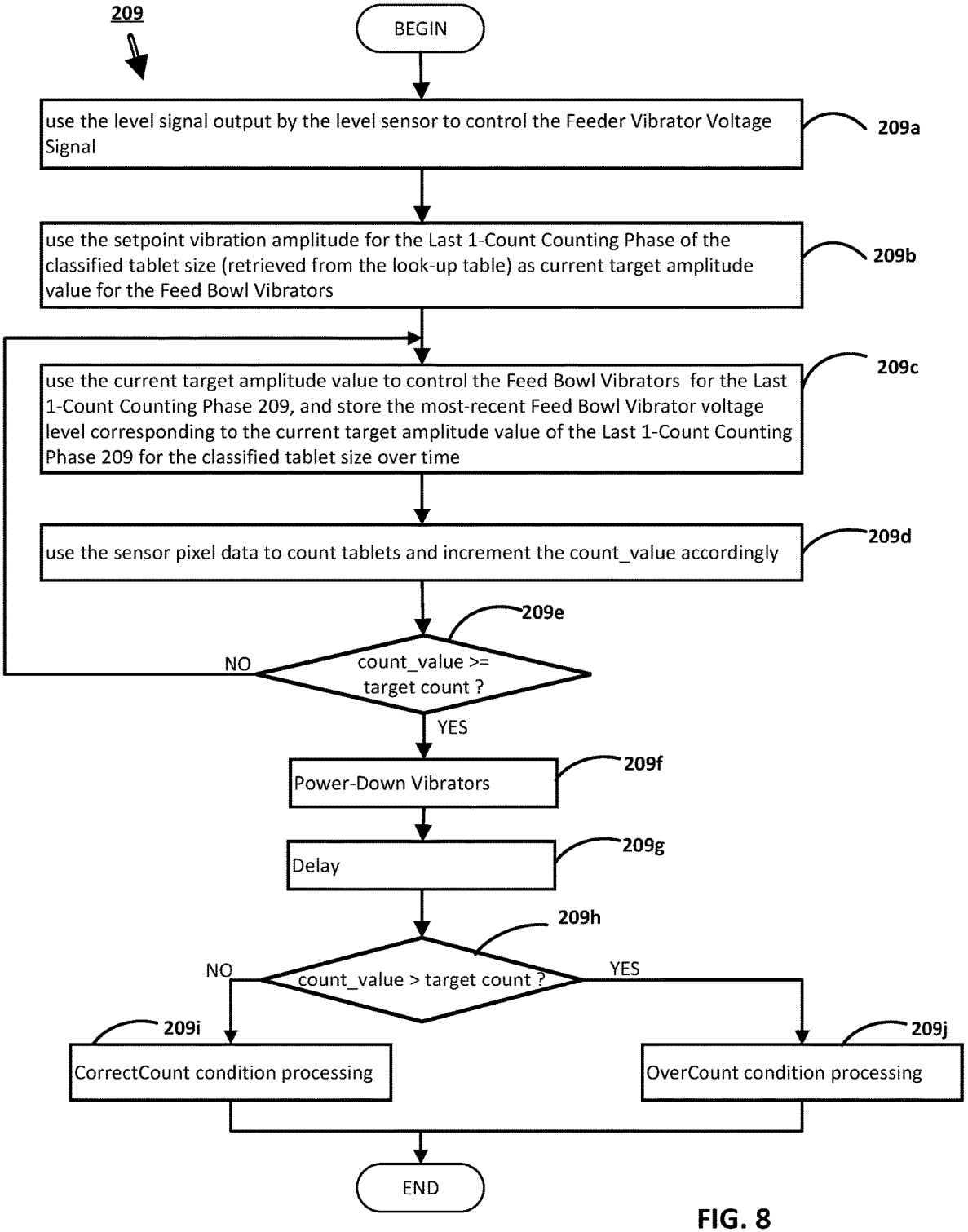
FIG. 8 is a flowchart illustrating exemplary operations that can be part of the last 1-count counting phase 209 of the workflow of FIGS. 2A and 2B.

Following the last 2-count counting phase 208, a last 1-count counting phase is performed at block 209, further details of which are shown with reference to the workflow shown in FIG. 8.

Upon the conclusion of the last 1-count counting phase 209, the number of tablets counted and dispensed by the apparatus 100 in blocks 205-209 typically matches the target number of tablets (a correct count condition). In some cases, the number of tablets counted and dispensed by the apparatus 100 in blocks 205-209 exceeds the target number of tablets (an overcount condition), which requires can involve special processing to handle the error. The operations then continue to blocks 210 to 215 to handle second or subsequent count commands transmitted by the host controller 124 and received by the communication interface 123.

At block 210, the communication interface 123 is placed in a state to wait to receive a second or subsequent count command from the host controller 124. Similar to the first count command, the second or subsequent count commands includes a command to the apparatus 100 to dispense a target number of tablets. If a second or subsequent count command is not received ("NO" at block 210), then the apparatus 100 continues to wait and check to determine if a second or subsequent count command is received. However, if a count command is received ("YES" at block 210), then the second or subsequent count command processing operations of blocks 211 to 215 are performed.

In block 211, a "target count" variable stored in memory is initialized to the target number of tablets as specified by the second or subsequent count command and the tablet counter variable "count_value" stored in memory is initialized to zero. The count_value variable is used to represent a cumulative number of counted tablets.

Figure 9:
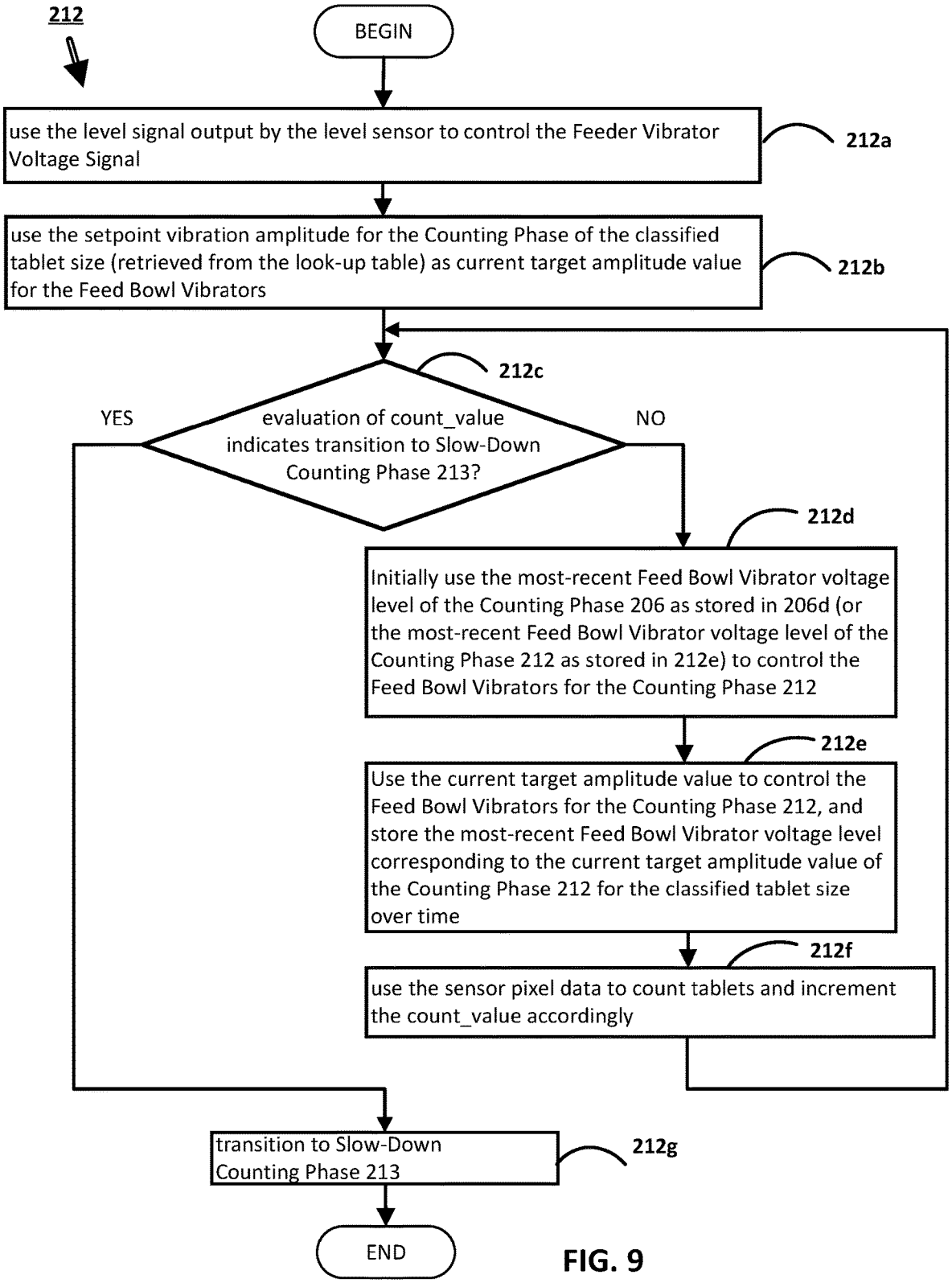
FIG. 9 is a flowchart illustrating exemplary operations that can be part of the counting phase 212 of the workflow of FIGS. 2A and 2B.

In block 212, a counting phase may be performed, further details of which are shown with reference to the workflow shown in FIG. 9.

Figure 10:
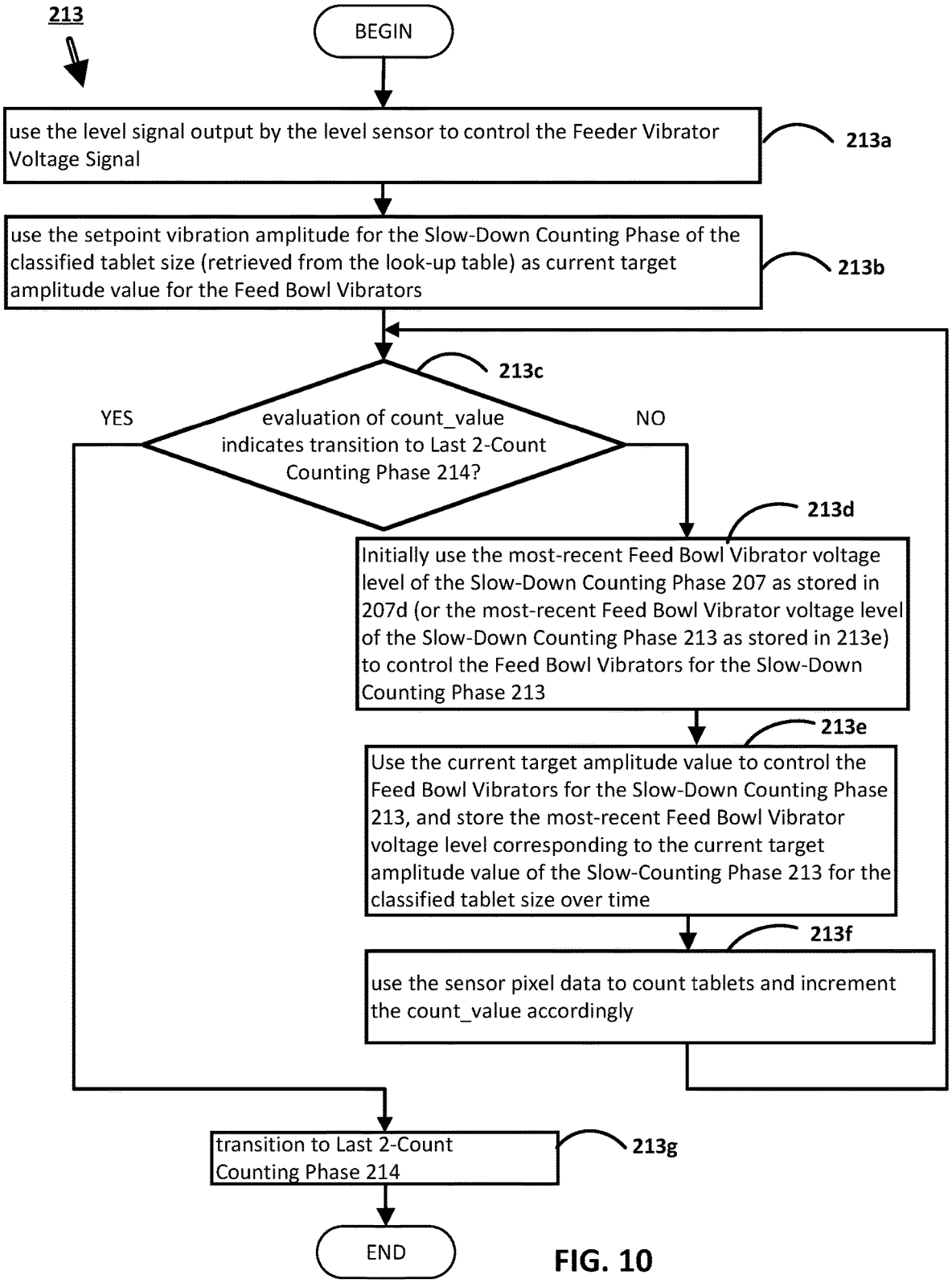
FIG. 10 is a flowchart illustrating exemplary operations that can be part of the slow-down counting phase 213 of the workflow of FIGS. 2A and 2B.

Following the counting phase 212, a slow-down counting phase is performed at block 213, further details of which are shown with reference to the workflow shown in FIG. 10.

Figure 11:
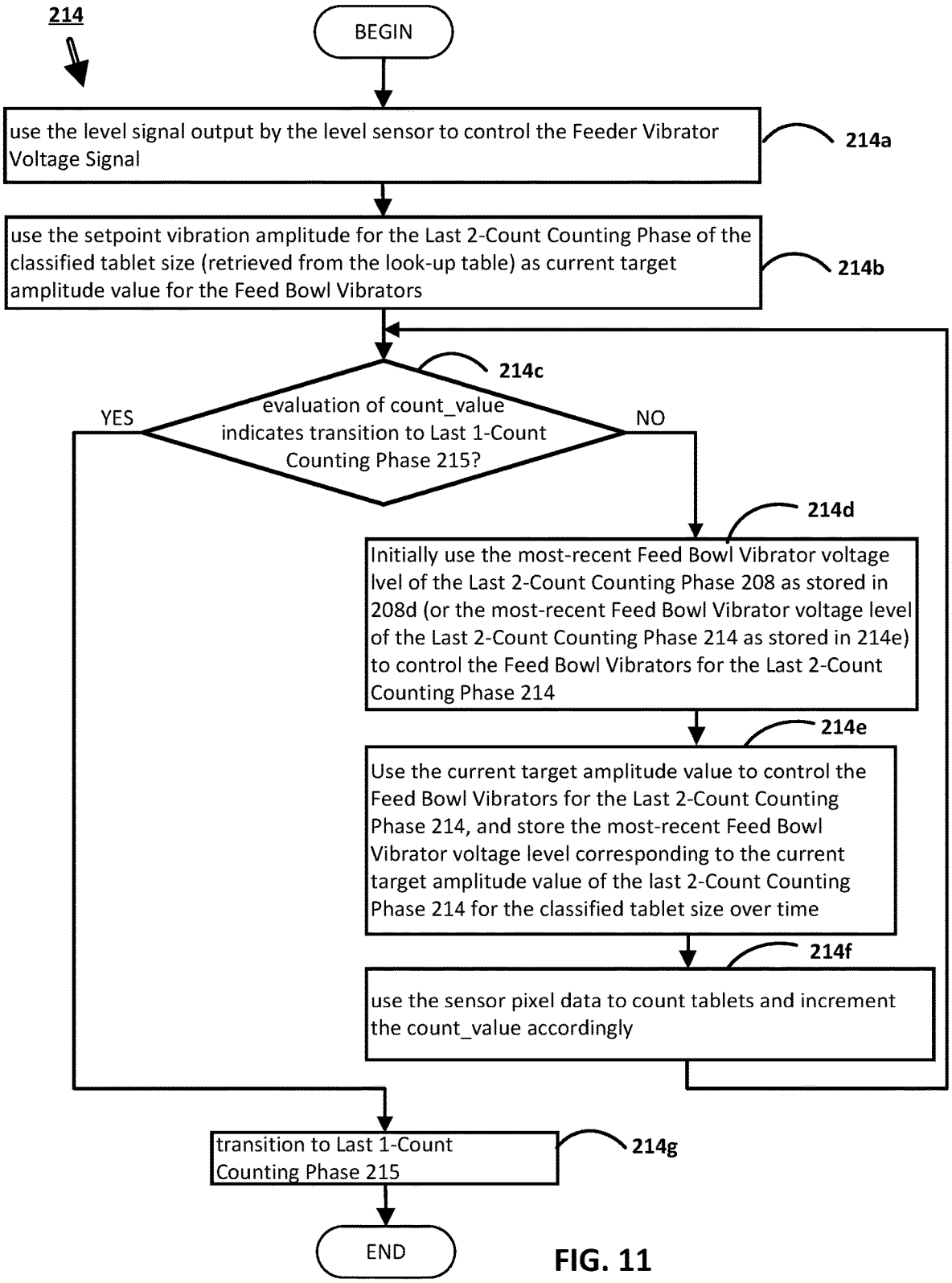
FIG. 11 is a flowchart illustrating exemplary operations that can be part of the last 2-count counting phase 214 of the workflow of FIGS. 2A and 2B.

Following the slow-down counting phase 213, a last 2-count counting phase is performed at block 214, further details of which are shown with reference to the workflow shown in FIG. 11.

Figure 12:
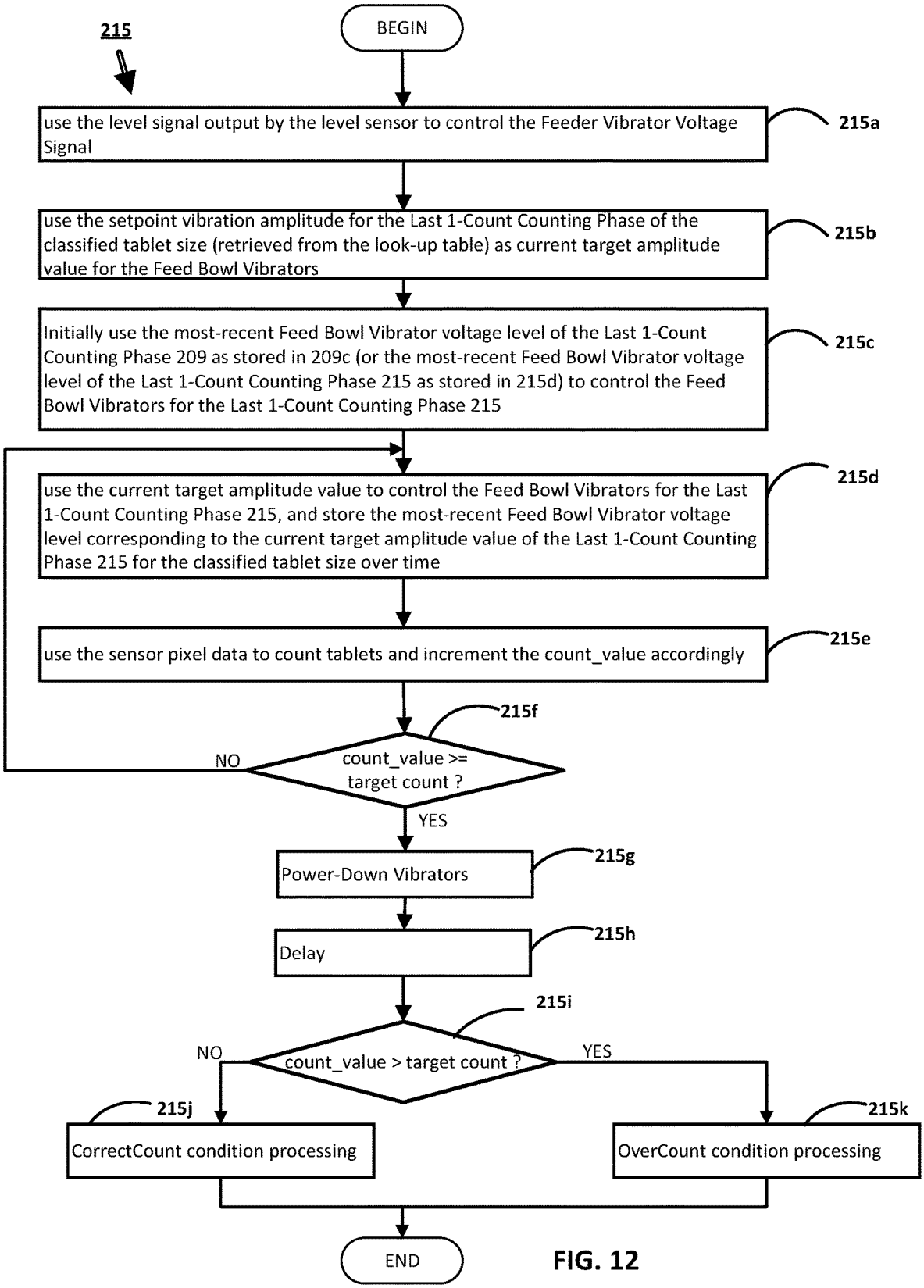
FIG. 12 is a flowchart illustrating exemplary operations that can be part of the last 1-count counting phase 215 of the workflow of FIGS. 2A and 2B.

Following the last 2-count counting phase 214, a last 1-count counting phase is performed at block 215, further details of which are shown with reference to the workflow shown in FIG. 12.

Upon the conclusion of the last 1-count counting phase 215, the number of tablets counted and dispensed by the apparatus 100 in blocks 211-215 typically matches the target number of tablets (a correct count condition). In some cases, the number of tablets counted and dispensed by the apparatus 100 in blocks 211-215 exceeds the target number of tablets (an overcount condition), which requires can involve special processing to handle the error.

Note that the operations of blocks 211 to 215 can be repeated to handle subsequent count commands transmitted by the host controller 124 and received by the communication interface 123 until the apparatus is powered off. When the apparatus is next powered up, the operations revert to the operations beginning at blocks 201 and 202 as described above.

FIG. 3 illustrates a sequence of automated operations carried out by the processor/control circuitry 110 for the initial counting phase 205 of FIG. 2A. At block 205*a*, the operations index into a lookup table 400 (FIG. 4) using a default tablet size class, which is used to retrieve corresponding operational parameters (e.g., default setpoint vibration amplitude for the feed bowl vibrators 115 for the initial counting phase and a "default count_value for transition to the slow-down counting phase") to start the initial counting phase. The "default count_value for transition to slow-down counting phase" represents a threshold cumulative number of tablets counted after which the counting workflow is slowed down so as to achieve a higher degree of control and accuracy of the count. For example, for a target count of 100 tablets, the default count_value for transition to slow-down counting phase may be 80, such that when the "count_value" reaches 80 tablets, the operations automatically transition to a slow-down counting phase where the apparatus 100 is controlled to dispense tablets at a slower rate to improve control of the count and thereby improve accuracy and precision. The lookup table can store variable count_values for transition to the slow-down counting phase" for different tablet sizes, if desired.

At block 205*b*, the level signal 109 output by the level sensor 107 is used by the processor/control circuitry 110 to control the feeder vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 205*c*, the setpoint vibration amplitude, as retrieved from the look-up table 400 in block 205*a*, is used as the current target amplitude value for the feed bowl vibrators 115. In general, the amplitude values in table 400 increase with increasing tablet size, as determined by testing.

At block 205*d*, the operations evaluate the count_value to determine if it indicates that a transition to the counting phase 206 should occur. Such evaluation can involve comparing the count_value to a predefined count_value for transition to the counting phase 206. If the count_value is equal to (or greater than) this predefined count_value (YES at block 205*d*), then the operations automatically transition to the counting phase 206 at block 205*h*. If the count_value is less than the predefined count_value (NO at block 205*d*), then the operations continue to blocks 205*e* to 205*g*.

At block 205*e*, the current target amplitude value for the feed bowl vibrators 115 (as set in block 205*c* or updated in block 205*f*) is used by the processor/control circuitry 110 to control the feed bowl vibrators 115 for the initial counting phase 205. For example, the processor/control circuitry 110 may employ a control scheme (such a PID control scheme) that incrementally increases (or possibly decreases) a vibrator voltage level such that feed bowl vibrators 115 reach the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115.

At block 205*f*, the sensor pixel data output by the sensor array 118 is used by the processor/control circuitry 110 to count tablets and increment the count_value variable accordingly. Also, in block 205*f*, the sensor pixel data is used to classify the tablet size and update the current target amplitude value for the feed bowl vibrators 115 and other operations parameters for all counting phases of the first count command processing of blocks 204 to 209 based on the entries in the look-up table 400 corresponding to the classified tablet size. After completing block 205*f*, the operations continue to block 205*g*. Note that classified tablet size and corresponding operations parameters can possibly be updated over time at block 205*f* during the counting and dispensing operations of the initial counting phase 205.

At block 205*g*, the operations process the signal 117 to determine whether the amplitude of vibration of the feed bowl 113 has overshot the current target amplitude value for the feed bowl vibrators 115 as set in block 205*c*. If not (NO at block 205*g*), the operations return to block 205*d*. This situation corresponds to a case where the amplitude signal is still increasing towards the target amplitude. If so (YES at block 205*g*), the operations continue to block 205*h*.

At block 205*h*, the operations transition to the counting phase 206 of FIG. 2A.

FIG. 5 illustrates a sequence of automated operations carried out by the processor/control circuitry 110 for the counting phase 206 of FIG. 2A. At block 206*a*, the level signal 109 output by the level sensor 107 is used by the processor/control circuitry 110 to control the feeder vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 206*b*, the setpoint vibration amplitude for the feed bowl vibrators 115 for the counting phase (as retrieved from the look-up table preferably at block 205*f*) is used as the current target amplitude value for the feed bowl vibrators 115.

At block 206*c*, the operations evaluate the count_value to determine if it indicates that a transition to the slow-down counting phase 207 should occur. Such evaluation can involve comparing the count_value to the count_value for transition to the slow-down counting phase (as retrieved from the look-up table preferably at block 205*a* or 205*f*). If the count_value is equal to (or greater than) the count_value for transition to the slow-down counting phase (YES at block 206*c*), then the operations automatically transition to the slow-down counting phase 206 at block 206*f*. If the count_value is less than the count_value for transition to the slow-down counting phase (NO at block 206*c*), then the operations continue to blocks 206*d* to 206*e*.

At block 206*d*, the current target amplitude value for the feed bowl vibrators 115 (as set in block 206*b* or updated in block 206*e*) is used by the processor/control circuitry 110 to control the feed bowl vibrators 115 for the counting phase 206. For example, the processor/control circuitry 110 may employ a control scheme (such a PID control scheme) that incrementally increases (or possibly decreases) the vibrator voltage level such that feed bowl vibrators 115 reach the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115. In such a case, the PID values employed during the counting phase 206 may be less aggressive than those used during the initial counting phase 205 to mitigate overshooting the current target amplitude. Furthermore, at block 206*d*, the most-recent vibrator voltage level corresponding to the current target amplitude value of the counting phase 206 for the classified tablet size can be stored over time.

At block 206*e*, the sensor pixel data generated by the sensor array 118 is used to count tablets and increment the count_value accordingly. Also, at block 206*e*, the sensor pixel data is used to update the classification of the tablet size and update the current target amplitude value for the feed bowl vibrators 115 and other operations parameters for all counting phases of the first count command processing of blocks 204 to 209 based on the entries of the lookup table 400 corresponding to the updated classified tablet size. After completing block 206*e*, the operations return to block 206*c*. Note that classified tablet size and corresponding operations parameters can possibly be updated over time at block 206*e* during the counting and dispensing operations of the counting phase 206.

At block 206*f*, the operations transition to the slow-down counting phase 207 of FIG. 2A.

FIG. 6 illustrates a sequence of automated operations carried out by the processor/control circuitry 110 for the slow-down counting phase 207 of FIG. 2A. At block 207*a*, the level signal 109 output by the level sensor 107 is used by the processor/control circuitry 110 to control the feeder vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 207*b*, the setpoint vibration amplitude for the slow-down counting phase (as retrieved from the look-up table 400 preferably in block 205*f* or 206*e*) is used as the current target amplitude value for the feed bowl vibrators 115.

At block 207*c*, the operations evaluate the count_value to determine if it indicates that a transition to the last 2-count counting phase 208 should occur. Such evaluation can involve comparing the difference between the target count and the count_value (i.e., (target count−count_value)) to a predefined count_value (e.g., 2) for transition to the last 2-count counting phase 208. If (target count−count_value) is equal to (or less than) this predefined count_value (e.g., 2) (YES at block 207*c*), then the operations automatically transition to the last 2-count counting phase 208 at block 207*f*. If (target count−count_value) is greater than this predefined count_value (e.g., 2) (NO at block 207*c*), then the operations continue to blocks 207*d* to 207*e*.

At block 207*d*, the current target amplitude value for the feed bowl vibrators 115 (as set in block 207*b* or updated in block 207*e*) is used by the processor/control circuitry 110 to control the feed bowl vibrators 115 for the slow-down counting phase 207. For example, the processor/control circuitry 110 may employ a control scheme (such a PID control scheme) that increases or decreases the vibrator voltage level such that feed bowl vibrators 115 operate at or near the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115. In such a case, the PID values employed during the slow-down counting phase may be less aggressive than those used during the initial counting phase and/or the second counting phase to mitigate overshooting the target amplitude. Furthermore, at block 207*d*, the most-recent vibrator voltage level corresponding to the current target amplitude value of the slow-down counting phase 207 for the classified tablet size can be stored over time.

At block 207*e*, the sensor pixel data is used to count tablets and increment the count_value accordingly. Also, at block 207*e* the sensor pixel data is used to update the classification of the tablet size and update the current target amplitude value for the feed bowl vibrators 115 and other operations parameters for all counting phases of the first count command processing of blocks 204 to 209 based on the entries of the lookup table 400 corresponding to the updated classified tablet size. After completing block 207*e*, the operations return to block 207*c*. Note that classified tablet size and corresponding operations parameters can possibly be updated over time at block 207*e* during the counting and dispensing operations of the slow-down counting phase 207.

At block 207*f*, the operations transition to the last 2-count counting phase 208 of FIG. 2A.

FIG. 7 illustrates a sequence of automated operations carried out by the processor/control circuitry 110 for the last 2-count counting phase 208 of FIG. 2A. At block 208*a*, the level signal 109 output by the level sensor 107 is used by the processor/control circuitry 110 to control the hopper vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 208*b*, the setpoint vibration amplitude for the last 2-count counting phase (as retrieved from the look-up table 400 preferably in block 205*f* or 206*e* or 207*e*) is used as the current target amplitude value for the feed bowl vibrators 115.

At block 208*c*, the operations evaluate the count_value to determine if it indicates that a transition to the last 1-count counting phase 209 should occur. Such evaluation can involve comparing the difference between the target count and the count_value (i.e. (target count−count_value)) to a predefined count_value (e.g., 1) for transition to the last 1-count counting phase 209. If (target count−count_value) is equal to (or less than) this predefined count_value (e.g., 1) (YES at block 208*c*), then the operations automatically transition to the last 1-count counting phase 209 at block 208*f*. If (target count−count_value) is greater than this predefined count_value (e.g., 1) (NO at block 208*c*), then the operations continue to blocks 208*d* to 208*e*.

At block 208*d*, the current the target amplitude value for the feed bowl vibrators 115 (as set in block 208*b* or updated in block 208*e*) is used by the processor/control circuitry 110 to control the feed bowl vibrators 115 for the last 2-count counting phase 208. For example, the processor/control circuitry 110 may employ a control scheme (such a PID control scheme) that increases or decreases the vibrator voltage level such that feed bowl vibrators 115 operate at or near the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115. In such a case, the PID values employed during the last 2-count counting phase may be less aggressive than those used during the initial counting phase, the second counting phase, and the slow-down counting phase to mitigate overshooting the target amplitude. Furthermore, at block 208*d*, the most-recent vibrator voltage level corresponding to the current target amplitude value of the last 2-count counting phase 208 for the classified tablet size can be stored over time.

At block 208*e*, the sensor pixel data generated by the sensor array 118 is used to count tablets and increment the count_value accordingly. Also, at block 208*e*, the sensor pixel data is used to update the classification of the tablet size and update the current target amplitude value for the feed bowl vibrators 115 and other operations parameters for all counting phases of the first count command processing of blocks 204 to 209 based on the entries of the lookup table 400 corresponding to the classified tablet size. After completing block 208*e*, the operations return to block 208*c*. Note that classified tablet size and corresponding operations parameters can possibly be updated over time at block 208*e* during the counting and dispensing operations of the last 2-count counting phase 208.

At block 208*f*, the operations transition to the last 1-count counting phase 209 of FIG. 2A.

FIG. 8 illustrates a sequence of automated operations carried out by the processor/control circuitry 110 for the last 1-count counting phase 209 of FIG. 2A. At block 209*a*, the level signal 109 output by the level sensor 107 is used to control the hopper vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 209*b*, the setpoint vibration amplitude for the last 1-count counting phase (as retrieved from the look-up table 400 in block 205*f* or 206*e* or 207*e* or 208*e*) is used as the current target amplitude value for the feed bowl vibrators 115.

At block 209*c*, the current target amplitude value for the feed bowl vibrators 115 (as set in block 209*b*) is used by the processor/control circuitry 110 to control the feed bowl vibrators 115 for the last 1-count counting phase 209. For example, the processor/control circuitry 110 may employ a control scheme (such a PID control scheme) that increases or decreases the vibrator voltage level such that feed bowl vibrators 115 operate at or near the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115. In such a case, the PID values employed during the last 1-count counting phase may be less aggressive than those used during the initial counting phase, the second counting phase, the slow-down counting phase, and the last 2-count counting phase to mitigate overshooting the target amplitude. Furthermore, at block 209*c*, the most-recent vibrator voltage level corresponding to the current target amplitude value of the last 1-count counting phase 209 for the classified tablet size can be stored over time.

At block 209*d*, the sensor pixel data is used to count tablets and increment the count_value accordingly.

At block 209*e*, the count_value is evaluated to determine if it is greater than or equal to the target count. If the count_value is determined to be less than the target count (NO at block 209*e*), then the operations automatically return to repeat the operations of blocks 209*c* to 209*e*. If the count_value is determined to be greater than or equal to the target count (YES at block 209*e*), then the operations automatically transition to the operations of blocks 209*f* to 209*h*.

At block 209*f*, the feed bowl vibrators 115 are powered-down by supply of appropriate voltage signals 127 and corresponding drive signals 116.

At block 209*g*, the operations delay for a short period of time to allow for any "late arriving" tablets that are possibly fed to the optical system 118 to arrive for counting and follow on dispensing.

At block 209*h*, the count_value is evaluated to determine if it is greater than the target count. If the count_value is determined to be greater than the target count (YES at block 209*h*), then the operations automatically transition to the OverCount condition processing at block 209*j*. This condition corresponds to the case where the apparatus counts and dispenses more tablets than requested by the host controller 124 and is a dispense error condition. The processor/control circuitry 110 can cooperate with the communication interface 123 of the apparatus 100 to report this dispense error condition to the external host controller 124 such that appropriate action can be taken to account for and remedy the dispense error condition. Otherwise, if the count_value is determined to be not greater than the target count (NO at block 209*h*), then the operations automatically transition to the CorrectCount condition processing at block 209*i*. This condition corresponds to the case where the apparatus counts and dispenses the proper number of tablets as requested by the host controller 124 and is a dispense success condition. The processor/control circuitry 110 can cooperate with the communication interface 123 of the apparatus 100 to report this dispense success to the external host controller 124 such that appropriate action can be taken to account the dispense success condition.

FIG. 9 illustrates a sequence of automated operations carried out by the processor/control circuitry 110 for the counting phase 212 of FIG. 2B. At block 212*a*, the level signal 109 output by the level sensor 107 is used by the processor/control circuitry 110 to control the feeder vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 212*b*, the setpoint vibration amplitude for the feed bowl vibrators 115 for the counting phase (as retrieved from the look-up table preferably at block 205*f* or 206*e* or 207*e* or 208*e* as described herein) is used as the current target amplitude value for the feed bowl vibrators 115.

At block 212*c*, the operations evaluate the count_value to determine if it indicates that a transition to the slow-down counting phase 213 should occur. Such evaluation can involve comparing the count_value to the count_value for transition to the slow-down counting phase (as retrieved from the look-up table preferably at block 212*a* or 212*f*). If the count_value is equal to (or greater than) the count_value for transition to the slow-down counting phase (YES at block 212*c*), then the operations automatically transition to the slow-down counting phase 213 at block 212*g*. If the count_value is less than the count_value for transition to the slow-down counting phase (NO at block 212*c*), then the operations continue to blocks 212*d* to 212*e*.

At block 212*d*, the most-recent vibrator voltage level of the counting phase as stored in block 206*d* (or the most-recent vibrator voltage level of the counting phase as stored in block 212*e*) can be used to initially control the feed bowl vibrators 115 for the counting phase 212.

At block 212*e*, the current target amplitude value for the feed bowl vibrators 115 (as set in block 212*b*) is used by the processor/control circuitry 110 to control the feed bowl vibrators 115 for the counting phase 212. For example, the processor/control circuitry 110 may employ a control scheme (such a PID control scheme) that increases or decreases the vibrator voltage level such that feed bowl vibrators 115 operate at or near the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115. Furthermore, at block 212*e*, the most-recent vibrator voltage level corresponding to the current target amplitude value of the counting phase 212 for the classified tablet size can be stored over time.

At block 212*f*, the sensor pixel data generated by the sensor array 118 is used to count tablets and increment the count_value accordingly. After completing block 212*f*, the operations return to block 212*c*. Note that in this exemplary embodiment, the sensor pixel data is not used to update the classified tablet size and corresponding operations parameters over time at block 212*f* during the counting and dispensing operations of the counting phase 212.

At block 212*g*, the operations transition to the slow-down counting phase 213 of FIG. 2B.

FIG. 10 illustrates a sequence of automated operations carried out by the processor/control circuitry 110 for the slow-down counting phase 213 of FIG. 2B. At block 213*a*, the level signal 109 output by the level sensor 107 is used by the processor/control circuitry 110 to control the feeder vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 213*b*, the setpoint vibration amplitude for the slow-down counting phase (as retrieved from the look-up table 400 preferably at block 205*f* or 206*e* or 207*e* or 208*e* as described herein) is used as the current target amplitude value for the feed bowl vibrators 115.

At block 213*c*, the operations evaluate the count_value to determine if it indicates that a transition to the last 2-count counting phase 214 should occur. Such evaluation can involve comparing the difference between the target count and the count_value (i.e., (target count−count_value)) to a predefined count_value (e.g., 2) for transition to the last 2-count counting phase 214. If (target count−count_value) is equal to (or less than) this predefined count_value (e.g., 2) (YES at block 213*c*), then the operations automatically transition to the last 2-count counting phase 214 at block 213*g*. If (target count−count_value) is greater than this predefined count_value (e.g., 2) (NO at block 213*c*), then the operations continue to blocks 213*d* to 213*f*.

At block 213*d*, the most-recent vibrator voltage level of the slow-down counting phase as stored in block 207*d* (or the most-recent vibrator voltage level of the slow-down counting phase as stored in block 213*e*) can be used to initially control the feed bowl vibrators 115 for the slow-down counting phase 213.

At block 213*e*, the current target amplitude value for the feed bowl vibrators 115 (as set in block 213*b*) is used by the processor/control circuitry 110 to control the feed bowl vibrators voltage signal 127 for the slow-down counting phase 213. For example, the processor/control circuitry 110 may employ a control scheme (such a PID control scheme) that increases or decreases the vibrator voltage level such that feed bowl vibrators 115 operate at or near the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115. Furthermore, at block 213*e*, the most-recent vibrator voltage level corresponding to the current target amplitude value of the slow-down counting phase 213 for the classified tablet size can be stored over time.

At block 213*f*, the sensor pixel data generated by the sensor array 118 is used to count tablets and increment the count_value accordingly. After completing block 213*f*, the operations return to block 213*c*. Note that in this exemplary embodiment, the sensor pixel data is not used to update the classified tablet size and corresponding operations parameters over time at block 213*f* during the counting and dispensing operations of the slow-down counting phase 213.

At block 213*g*, the operations transition to the last 2-count counting phase 214 of FIG. 2B.

FIG. 11 illustrates a sequence of automated operations carried out by the processor/control circuitry 110 for the last 2-count counting phase 214 of FIG. 2B. At block 214*a*, the level signal 109 output by the level sensor 107 is used by the processor/control circuitry 110 to control the feeder vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 214*b*, the setpoint vibration amplitude for the last 2-count counting phase (as retrieved from the look-up table 400 preferably at block 205*f* or 206*e* or 207*e* or 208*e* as described herein) is used as the current target amplitude value for the feed bowl vibrators 115.

At block 214*c*, the operations evaluate the count_value to determine if it indicates that a transition to the last 1-count counting phase 215 should occur. Such evaluation can involve comparing the difference between the target count and the count_value (i.e. (target count−count_value)) to a predefined count_value (e.g., 1) for transition to the last 1-count counting phase 215. If (target count−count_value) is equal to (or less than) this predefined count_value (e.g., 1) (YES at block 214*c*), then the operations automatically transition to the last 1-count counting phase 214 at block 214*g*. If (target count−count_value) is greater than this predefined count_value (e.g., 1) (NO at block 214*c*), then the operations continue to blocks 214*d* to 214*f*.

At block 214*d*, the most-recent vibrator voltage level of the last 2-count counting phase as stored in block 208*d* (or the most-recent vibrator voltage level of the slow-down counting phase as stored in block 214*e*) can be used to initially control the feed bowl vibrators 115 for the last 2-count counting phase 214.

At block 214*e*, the current the target amplitude value for the feed bowl vibrators 115 (as set in block 214*b*) is used by the processor/control circuitry 110 to control the feed bowl vibrators 115 for the last 2-count counting phase 214. For example, the processor/control circuitry 110 may employ a control scheme (such a PID control scheme) that increases or decreases the vibrator voltage level such that feed bowl vibrators 115 operate at or near the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115. In such a case, the PID values employed during the last 2-count counting phase may be less aggressive than those used during the initial counting phase, the second counting phase, and the slow-down counting phase to mitigate overshooting the target amplitude. Furthermore, at block 214*e*, the most-recent vibrator voltage level corresponding to the current target amplitude value of the last 2-count counting phase 214 for the classified tablet size can be stored over time.

At block 214*f*, the sensor pixel data generated by the sensor array 118 is used to count tablets and increment the count_value accordingly. After completing block 214*f*, the operations return to block 214*c*. Note that in this exemplary embodiment, the sensor pixel data is not used to update the classified tablet size and corresponding operations parameters over time at block 214*f* during the counting and dispensing operations of the last 2-count counting phase 214.

At block 214*g*, the operations transition to the last 1-count counting phase 215 of FIG. 2B.

FIG. 12 illustrates a sequence of automated operations carried out by the processor/control circuitry 110 for the last 1-count counting phase 215 of FIG. 2B. At block 215*a*, the level signal 109 output by the level sensor 107 is used to control the feeder vibrator voltage signal 126. For example, when the level signal 109 indicates that the tablet level in the feed bowl 113 is below a low limit, the processor/control circuitry 110 sends a feeder vibrator signal 126 to the control unit 111, which then transmits a drive signal 112 to the feeder vibrator 108*a* to drive the feeder vibrator 108*a* so that the linear feeder 108 conveys tablets to the feed bowl 113 to increase the level of tablets in the feed bowl 113. When a level of tablets in the feed bowl 113 reaches a predetermined amount, the level sensor 107 transmits the level signal 109 to the processor/control circuitry 110, which then, updates the feeder vibrator signal to the feeder control unit 111, which transmits an updated drive signal 112 to the feeder vibrator 108*a* to stop vibration of the feeder vibrator 108*a*.

At block 215*b*, the setpoint vibration amplitude for the last 1-count counting phase (as retrieved from the look-up table 400 preferably at block 205*f* or 206*e* or 207*e* or 208*e* as described herein) is used as the current target amplitude value for the feed bowl vibrators 115.

At block 215*c*, the most-recent vibrator voltage level of the last 1-count counting phase as stored in block 209*c* (or the most-recent vibrator voltage level of the slow-down counting phase as stored in block 215*d*) can be used to initially control the feed bowl vibrators 115 for the last 1-count counting phase 215.

At block 215*d*, the current target amplitude value for the feed bowl vibrators 115 (as set in block 215*b*) is used by the processor/control circuitry 110 to control the feed bowl vibrators 115 for the last 1-count counting phase 215. For example, the processor/control circuitry 110 may employ a control scheme (such a PID control scheme) that increases or decreases the vibrator voltage level such that feed bowl vibrators 115 operate at or near the current target amplitude value. Such vibrator voltage level is maintained by the processor/control circuitry 110 and is proportional to the voltage signal 127 supplied by the processor/control circuitry 110 to the control circuit 111 in controlling the feed bowl vibrators 115. In such a case, the PID values employed during the last 1-count counting phase may be less aggressive than those used during the counting phase 212, the slow-down counting phase 213, and the last 2-count counting phase 214 to mitigate overshooting the target amplitude. Furthermore, at block 2015*d*, the most-recent vibrator voltage level corresponding to the current target amplitude value of the last 1-count counting phase 215 for the classified tablet size can be stored over time.

At block 215*e*, the sensor pixel data is used to count tablets and increment the count_value accordingly.

At block 215*f*, the count_value is evaluated to determine if it is greater than or equal to the target count. If the count_value is determined to be less than the target count (NO at block 215*f*), then the operations automatically return to repeat the operations of blocks 215*d* to 2215*f*. If the count_value is determined to be greater than or equal to the target count (YES at block 215*f*), then the operations automatically transition to the operations of blocks 209*g* to 209*i*.

At block 215*g*, the feed bowl vibrators 115 are powered-down by supply of appropriate voltage signals 127 and corresponding drive signals 116.

At block 215*h*, the operations delay for a short period of time to allow for any "late arriving" tablets that are possibly fed to the optical system 118 to arrive for counting and follow on dispensing.

At block 215*i*, the count_value is evaluated to determine if it is greater than the target count. If the count_value is determined to be greater than the target count (YES at block 215*i*), then the operations automatically transition to the OverCount condition processing at block 215*k*. This condition corresponds to the case where the apparatus counts and dispenses more tablets than requested by the host controller 124 and is a dispense error condition. The processor/control circuitry 110 can cooperate with the communication interface 123 of the apparatus 100 to report this dispense error condition to the external host controller 124 such that appropriate action can be taken to account for and remedy the dispense error condition. Otherwise, if the count_value is determined to be not greater than the target count (NO at block 215*i*), then the operations automatically transition to the CorrectCount condition processing at block 215*j*. This condition corresponds to the case where the apparatus counts and dispenses the proper number of tablets as requested by the host controller 124 and is a dispense success condition. The processor/control circuitry 110 can cooperate with the communication interface 123 of the apparatus 100 to report this dispense success to the external host controller 124 such that appropriate action can be taken to account the dispense success condition.

Figure 13:
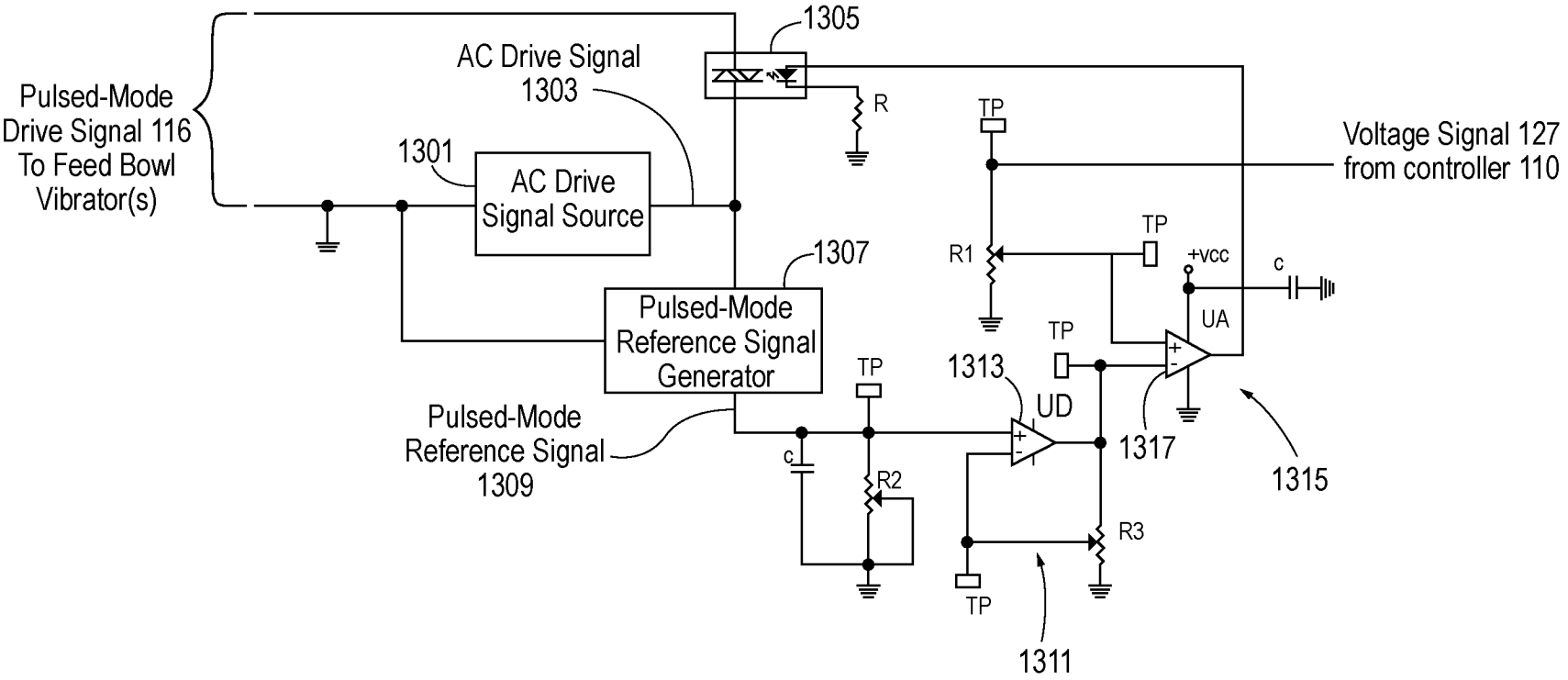
FIG. 13 is a high level schematic diagram of an exemplary control circuit used to control the feed bowl vibrators of the apparatus of FIGS. 1A to 1C.

FIG. 13 is a schematic diagram of an exemplary embodiment of the Vibratory Feeder Control Circuit 111 of FIG. 1A, which includes an AC Drive Signal Source 1301 that produces an AC Drive Signal 1303 that is supplied to both an opto-isolator triac device 1305 and a pulsed-mode reference signal generator circuit 1307. The pulsed-mode reference signal generator circuit 1307 generates a pulse-mode reference signal 1309 having pulses that are synchronized to the AC waveforms of the AC Drive Signal 1303. The pulse-mode reference signal 1309 is supplied as an input to an amplifier stage 1311. The amplifier stage 1311 includes an op-amp 1313 whose positive input is supplied with the pulse-mode reference signal 1309 conditioned by an R-C circuit including a variable resistance provided by potentiometer R2. The feedback path from the negative input of the op-amp 1313 to its output includes variable resistance provided by potentiometer R3. The output of the amplifier stage 1311 (which is provided at the output of the op-amp 1313) is supplied to a comparator stage 1315. The comparator stage 1315 includes a comparator 1317 whose negative input is supplied with the output of the amplifier stage 1311. The positive input of the comparator 1317 is supplied with the voltage signal 127 supplied from the controller 110 conditioned by a voltage drop across a variable resistance provided by potentiometer R1. The output of the comparator stage 1315 (which is provided at the output of the comparator 1317) selectively activates and deactivates (or turns ON and OFF) a photodiode of the opto-isolator triac device 1305. When the photodiode of the opto-isolator triac device 1305 is activated or turned ON, the triac of the opto-isolator triac device 1305 turns ON such that the AC Drive Signal 1301 supplied thereto passes through the triac. When the photodiode of the opto-isolator triac device 1305 is deactivated or turned OFF, the triac of the opto-isolator triac device 1305 turns OFF such that the AC Drive Signal 1301 supplied thereto is blocked and does not pass through the triac. In this manner, the switching operation of the opto-isolator triac device 1305 produces the pulsed-mode drive signal 116 that is supplied to the feed bowl vibrators for controlled vibration of the feed bowl.

The variable resistances provided by the potentiometers R1, R2 and R3 allows for calibration of the mapping between the feed bowl vibrator voltage levels maintained by the controller 110 and the vibration amplitude of the feed bowl, which is used in the closed loop control of the vibration amplitude of the feed bowl during operation of the system as described herein. More specifically, the operational characteristics of the feed bowl vibrators can vary over different units as assembled or over time. In this case, without calibration, the feed bowl vibrator voltage levels maintained by the controller 110 can possibly result in unwanted variation in the vibration amplitude of the feed bowl over different units as assembled or over time. This can make lead to unnecessary complexity or unwanted errors in the control of the vibration amplitude of the feed bowl. The variable resistances provided by the potentiometers R1, R2 and R3 allows for calibration of the mapping between the feed bowl vibrator voltage levels maintained by the controller 110 and the vibration amplitude of the feed bowl in order to reduce such variations to an acceptable level.

The calibration operations involve adjusting the variable resistance provided by one or more of the potentiometers R1, R2 and R3 such that one or more predefined feed bowl vibrator voltage levels map to a corresponding target vibration amplitude of the feed bowl.

Figure 14A:
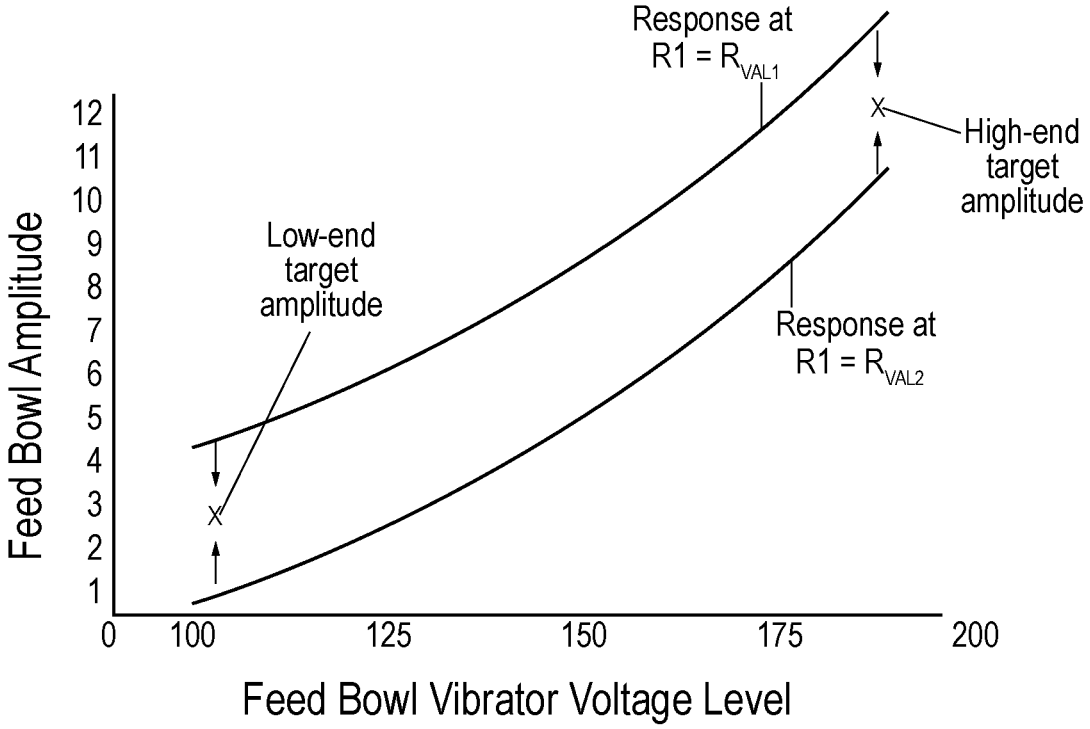
FIGS. 14A to 14C are plots illustrating exemplary calibration operations that adjust the variable resistance values of the control circuit of FIG. 13 such that one or more predefined feed bowl vibrator voltage levels map to a corresponding target vibration amplitude of the feed bowl.

The change of resistance provided by potentiometer R1 can be used primarily to adjust the scale of the feed bowl vibrator voltage levels relative to the vibration amplitude of the feed bowl. In this manner, the change of resistance provided by potentiometer R1 can be used to make course adjustments shown graphically by arrows in FIG. 14A such that the one or more predefined feed bowl vibrator voltage levels produce corresponding vibration amplitudes of the feed bowl that are near the corresponding target vibration amplitudes of the feed bowl.

Figure 14B:
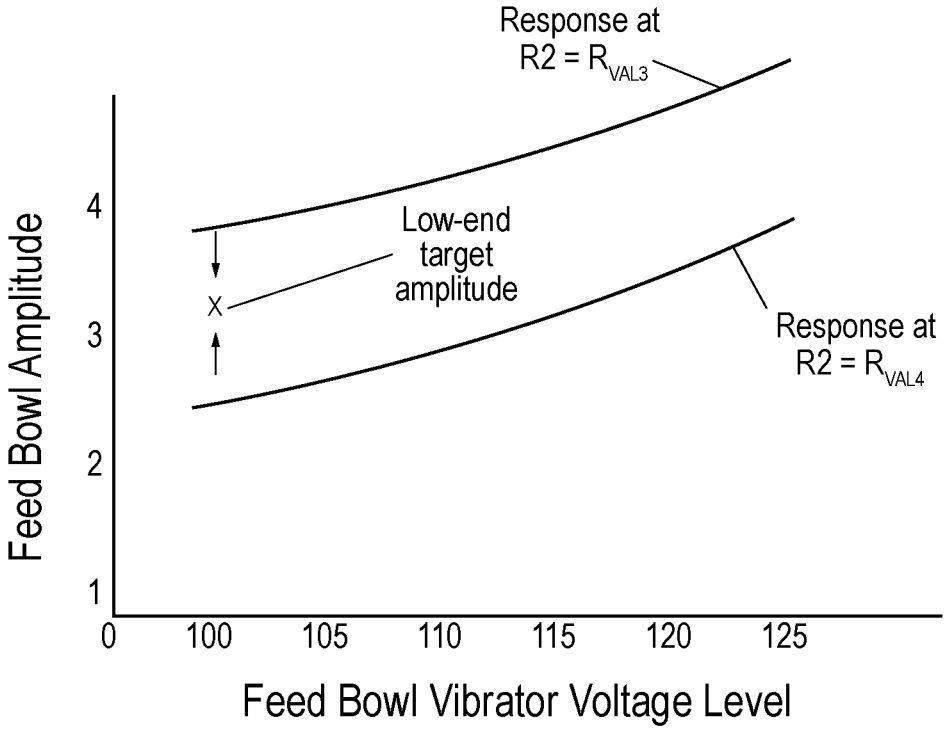

The change of resistance provided by potentiometer R2 can be used primarily to adjust the mapping of "lower" feed bowl vibrator voltage levels to vibration amplitude of the feed bowl. The "lower" feed bowl vibrator voltage levels fall within a range at the lower end of the possible feed bowl vibrator voltage levels. In this manner, the change of resistance provided by potentiometer R2 can be used to make fine adjustments shown graphically by arrows in FIG. 14B such that the one or more predefined feed bowl vibrator voltage levels within the lower end of the possible feed bowl vibrator voltage level produce corresponding vibration amplitudes of the feed bowl that are near the corresponding target vibration amplitudes of the feed bowl.

Figure 14C:
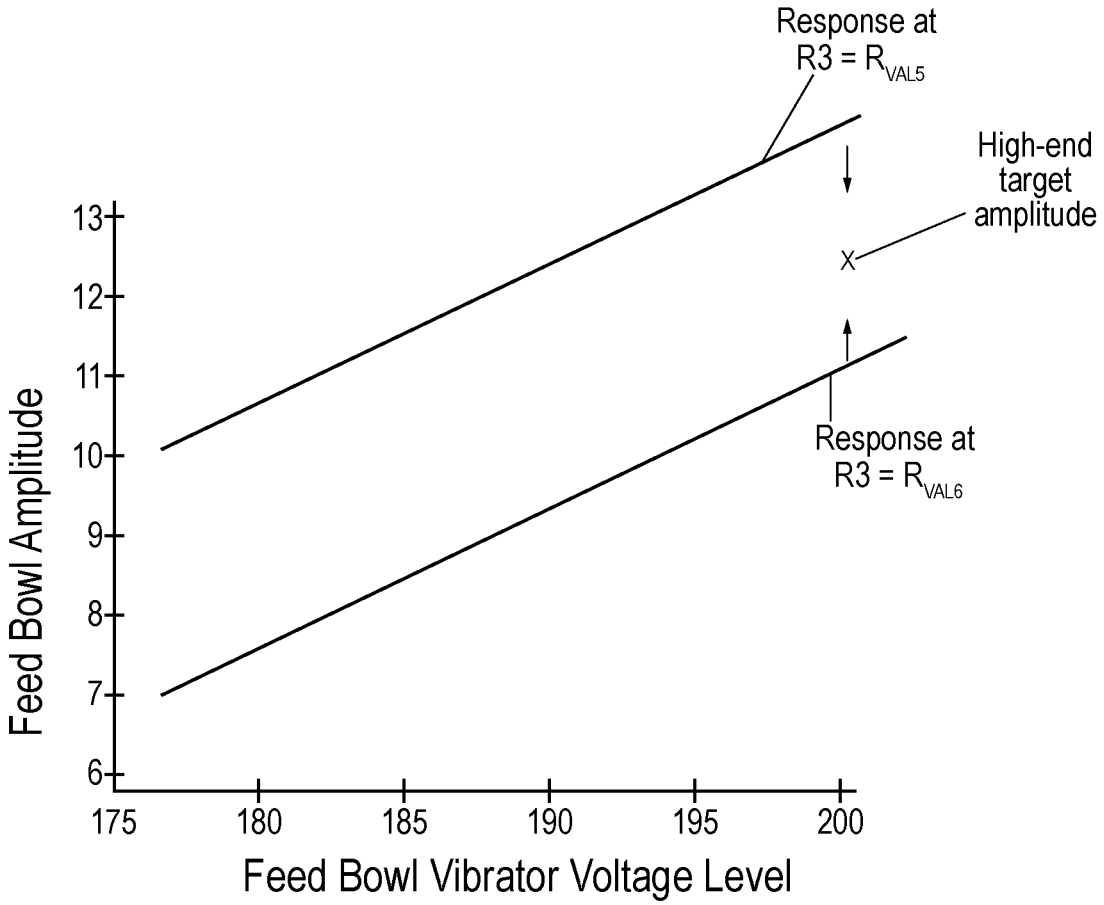

The change of resistance provided by potentiometer R3 can be used primarily to adjust the mapping of "higher" feed bowl vibrator voltage levels to vibration amplitude of the feed bowl. The "higher" feed bowl vibrator voltage levels fall within a range at the higher end of the possible feed bowl vibrator voltage levels. In this manner, the change of resistance provided by potentiometer R3 can be used to make fine adjustments as shown graphically by arrow in FIG. 14C such that the one or more predefined feed bowl vibrator voltage levels within the higher end of the possible feed bowl vibrator voltage level produce corresponding vibration amplitudes of the feed bowl that are near the corresponding target vibration amplitudes of the feed bowl.

It is contemplated that the calibration operations can involve multiple iterations that adjust the variable resistances provided by one or more of the potentiometers R1, R2 and R3 until one or more predefined feed bowl vibrator voltage levels map to a corresponding target vibration amplitude of the feed bowl.

There have been described and illustrated herein certain methods and devices for controlling the feed rate of an object sorter/counter. While particular embodiments of the invention have been described, it is not intended that the invention be limited thereto, as it is intended that the invention be as broad in scope as the art will allow and that the specification be read likewise. Thus, while particular dimensions, locations, and configurations of the hopper, feed bowl, vibrators, optical system, and control system have been disclosed, it will be appreciated that other dimensions, locations, and configurations could be utilized. Moreover, while particular configurations have been disclosed in reference to a microprocessor and certain software for use therewith, it will be appreciated that other types of processors and variations in the disclosed software could be used as well. Furthermore, while the counter section with sensor array and gate has been disclosed as having certain dimensions, locations, and configurations, it will be understood that different dimensions, locations, and configurations can achieve the same or similar function as disclosed herein. It will therefore be appreciated by those skilled in the art that yet other modifications could be made to the provided invention without deviating from its spirit and scope as so claimed.

What is claimed is:

1. An apparatus for counting and dispensing tablets, the apparatus comprising:

a) a tablet feeder for feeding tablets to be counted and dispensed, the tablet feeder having an output opening;

b) at least one electrically-controlled vibrator coupled to the tablet feeder for vibrating the tablet feeder such that a singulated flow of tablets exits the output opening;

c) an optical system including at least one light source and at least one detector array located about a channel disposed downstream from the output opening of the tablet feeder, wherein the optical system is configured to count tablets that pass through the channel as well as determine a tablet size class for the tablets that pass through the channel; and d) an electronic controller configured to control vibration amplitude of the at least one electrically-controlled vibrator based on the tablet size class determined by the optical system and the cumulative number of tablets counted by the optical system;

wherein the electronic controller includes a look-up table implemented in computer memory that electronically stores a number of vibration amplitude setpoints for the respective tablet size classes in each counting phase within a plurality of counting phases;

wherein the optical system is configured to determine or update the tablet size class during a counting and dispensing operation that counts and dispenses a desired number of tablets, the counting and dispensing operation logically partitioned to include the plurality of counting phases; and wherein the electronic controller uses at least one vibration amplitude setpoint stored in the look-up table and corresponding to the tablet size class determined or updated by the optical system to update or change the target vibration amplitude value for control of the vibration amplitude of the at least one electrically-controlled vibrator during each counting phase within the plurality of counting phases;

wherein the plurality of counting phases includes an initial counting phase carried out by the apparatus after an initial power-up sequence;

wherein the look-up table is configured to store a vibration amplitude setpoint that is used as a target vibration amplitude value for control of the vibration amplitude of the at least one electrically-controlled vibrator during the initial counting phase;

wherein the optical system is configured to determine or update the tablet size class during the initial counting phase; and wherein the electronic controller uses the vibration amplitude setpoint stored in the look-up table and corresponding to the tablet size class determined or updated by the optical system in the initial counting phase to update or change the target vibration amplitude value for control of the vibration amplitude of the at least one electrically-controlled vibrator during the initial counting phase; and wherein the electronic controller is configured to transition out of the initial counting phase when the vibration amplitude of the at least one electrically-controlled vibrator exceeds the target vibration amplitude value for the initial counting phase.

2. The apparatus according to claim 1, wherein:

the tablet feeder comprises a feed bowl having the output opening, wherein the feed bowl undergoes controlled vibration by the at least one electrically-controlled vibrator such that singulated flow of tablets exits the output opening.

3. The apparatus according to claim 1, wherein:

the plurality of counting phases include a first sequence of counting phases carried out by the vibratory counting apparatus after the initial counting phase; and the look-up table is configured to store vibration amplitude setpoints for control of the vibration amplitude of the at least one electrically-controlled vibrator during the first sequence of counting phases.

4. The apparatus according to claim 3, wherein:

the optical system is configured to determine or update the tablet size class during the first sequence of counting phases; and the electronic controller uses the vibration amplitude setpoints stored in the look-up table and corresponding to the tablet size class determined or updated by the optical system during the first sequence of counting phases to update or change the target vibration amplitude value for control of the vibration amplitude of the at least one electrically-controlled vibrator during the first sequence of counting phases.

5. The apparatus according to claim 4, wherein:

the follow-on counting and dispensing operations are logically partitioned into a second sequence of counting phases each corresponding to different counting phases of the first sequence; and during a respective counting phase of the second sequence, the electronic controller uses the data representing the most-recent voltage level at the vibration amplitude setpoint for the corresponding counting phase of the first sequence to initially control the at least one electrically-controlled vibrator.

6. The apparatus according to claim 4, wherein:

the electronic controller is configured to perform closed loop control of the at least one electrically-controlled vibrator based on difference between a measured amplitude of vibration of the least one electrically-controlled vibrator and a current target vibration amplitude; and the electronic controller is configured to increase a vibrator voltage level if the measured amplitude of vibration is less than the current target vibration amplitude, and the controller is configured to decrease the vibrator voltage level if the measured amplitude of vibration is greater than the current target vibration amplitude.

7. The apparatus according to claim 4, wherein:

the electronic controller is configured to electronically store in computer memory data representing most-recent voltage levels at the vibration amplitude setpoints for the first sequence of counting phases; and the electronic controller uses such data in follow-on counting and dispensing operations to control the vibration amplitude of the at least one electrically-controlled vibrator during such follow-on counting and dispensing operations.

8. The apparatus according to claim 3, wherein:

the first sequence of counting phases includes a counting phase, a slow-down counting phase, a last 2-count counting phase, and a last 1-count counting phase.

9. The apparatus according to claim 8, wherein:

the electronic controller is configured to transition from the counting phase to the slow-down counting phase when the cumulative number of counted and dispensed tablets is greater than or equal to a threshold value.

10. The apparatus according to claim 9, wherein:

the threshold value can be determined from one or more parameters stored in the look-up table for the respective tablet size class.

11. The apparatus according to claim 8, wherein:

the electronic controller is configured to transition from the slow-down counting phase to the last 2-count counting phase when a difference between the target number of tablets to be counted and dispensed and the cumulative number of counted and dispensed tablets is 3; and the electronic controller is configured to transition from the last 2-counting phase to a last 1-count counting phase when the difference between the target number of tablets to be counted and dispensed and the cumulative number of counted and dispensed tablets is 2.

12. The apparatus according to claim 11, wherein:

in the last 1-count counting phase, the electronic controller is configured to perform an overcount condition processing when the cumulative number of counted and dispensed tablets is greater than the target number of tablets to be counted and dispensed, and the controller is configured to perform a correct count condition processing when the cumulative number of counted and dispensed tablets is equal to the target number of tablets to be counted and dispensed.

* * * * *